US011986057B2

(12) United States Patent
Baggen et al.

(10) Patent No.: US 11,986,057 B2
(45) **Date of Patent: *May 21, 2024**

(54) FUNCTIONAL FOOTWEAR UNIT

(71) Applicant: Blücher GmbH, Erkrath (DE)

(72) Inventors: Brigitte Baggen, Erkrath (DE); Rainer Fischer, Erkrath (DE); Angela Bench-Wieber, Erkrath (DE); Carina Rogmann, Erkrath (DE)

(73) Assignee: BLUCHER GMBH (DE)

( * ) Notice: Subject to any disclaimer, the term of this patent is extended or adjusted under 35 U.S.C. 154(b) by 145 days.

This patent is subject to a terminal disclaimer.

(21) Appl. No.: 17/565,904

(22) Filed: Dec. 30, 2021

(65) Prior Publication Data

US 2022/0117352 A1 Apr. 21, 2022

Related U.S. Application Data

(63) Continuation of application No. 15/779,722, filed as application No. PCT/EP2016/068140 on Jul. 29, 2016, now Pat. No. 11,246,371.

(30) Foreign Application Priority Data

Nov. 30, 2015 (DE) ..... 102015015286.6
Jan. 5, 2016 (DE) ..... 102016100159.7

(51) Int. Cl.
*A43B 7/12* (2006.01)

(52) U.S. Cl.
CPC ..... *A43B 7/125* (2013.01)

(58) Field of Classification Search
CPC ..... A43B 7/125
USPC ..... 36/84
See application file for complete search history.

(56) References Cited

U.S. PATENT DOCUMENTS

| | | | | |
|---|---|---|---|---|
| 2,730,819 | A | 1/1956 | Foust | |
| 4,459,332 | A | 7/1984 | Giglia | |
| 4,877,018 | A | 10/1989 | Ikebe | |
| 4,930,175 | A * | 6/1990 | Chen | A43B 7/125 12/142 E |
| 5,222,313 | A * | 6/1993 | Dowdy | A47G 25/90 36/8.1 |
| 5,526,584 | A * | 6/1996 | Bleimhofer | A43B 17/107 36/55 |
| 6,981,341 | B2 | 1/2006 | Baychar | |
| 7,730,555 | B2 | 6/2010 | Hexels | |
| 8,266,726 | B2 | 9/2012 | Bohringer | |
| 2001/0008672 | A1 * | 7/2001 | Norvell | A41B 11/005 442/76 |
| 2003/0177566 | A1 | 9/2003 | Williams | |

(Continued)

FOREIGN PATENT DOCUMENTS

| | | |
|---|---|---|
| DE | 29620861 | 4/1947 |
| DE | 3132324 | 3/1983 |

(Continued)

*Primary Examiner* — Timothy K Trieu
(74) *Attorney, Agent, or Firm* — Edward E. Sowers; Brannon Sowers & Cracraft PC

(57) ABSTRACT

The invention relates to a functional footwear unit, in particular in the form of knit-of-parts, which has preferably a particularly modular protective function against chemical and/or biological toxic and/or harmful substances, especially warfare agents. The invention also relates to the uses thereof.

20 Claims, 3 Drawing Sheets

(56) References Cited

U.S. PATENT DOCUMENTS

| | | | | |
|---|---|---|---|---|
| 2005/0076541 | A1 | 4/2005 | von Blucher | |
| 2006/0065353 | A1 | 3/2006 | Williams | |
| 2007/0062067 | A1 | 3/2007 | Kovatch | |
| 2009/0158503 | A1 | 6/2009 | Duclos | |
| 2009/0235439 | A1 | 9/2009 | Cox | |
| 2011/0113538 | A1 | 5/2011 | von Blucher | |
| 2015/0230541 | A1 | 8/2015 | Bacino | |
| 2015/0230550 | A1 | 8/2015 | Bacino | |
| 2016/0037839 | A1* | 2/2016 | Vandenbosch ... | A41D 19/01576 2/457 |
| 2016/0309835 | A1 | 10/2016 | Maccioni | |

FOREIGN PATENT DOCUMENTS

| | | |
|---|---|---|
| DE | 3716303 | 11/1988 |
| DE | 4304026 | 9/1993 |
| DE | 4328219 | 2/1995 |
| DE | 19600237 | 7/1996 |
| DE | 20012098 | 12/2000 |
| DE | 20314754 | 12/2003 |
| DE | 20315766 | 11/2004 |
| DE | 20317080 | 12/2004 |
| DE | 202005007308 | 5/2005 |
| DE | 10356776 | 7/2005 |
| DE | 10357112 | 7/2005 |
| DE | 102005026837 | 8/2006 |
| DE | 202005007308 | 8/2006 |
| DE | 102007026340 | 6/2008 |
| EP | 1522229 | 4/2005 |
| EP | 1918022 | 5/2008 |
| WO | 2005053445 | 6/2005 |
| WO | 20080151692 | 12/2008 |
| WO | 2009056184 | 5/2009 |

* cited by examiner

FUNCTIONAL FOOTWEAR UNIT

CROSS-REFERENCES TO RELATED APPLICATIONS

This application is a continuation of U.S. application Ser. No. 15/779,722, entitled "FUNCTIONAL FOOTWEAR UNIT" filed May 29, 2018, which claims priority to PCT/EP 2016/068140, filed Jul. 29, 2016, and to German Applications DE 10 2015 015 286.6 filed Nov. 30, 2015, and DE 10 2016 100 159.7 filed Jan. 5, 2016, and incorporates all by reference herein, in their entirety.

BACKGROUND OF THE INVENTION

The present invention relates to the technical field of protective clothing or protective equipment for the foot area, which in particular is designed for military use or for the area of risk prevention and in particular has a protective function against radioactive, chemical or biological toxic and/or harmful substances, such as warfare agents, or has a corresponding chemical protective function.

Specifically, the present invention relates to a functional footwear unit, in particular in the form of a kit of parts, wherein the footwear unit according to the invention preferably has an in particular modular protective function against radioactive, chemical and/or biological toxic or harmful substances, in particular warfare agents, and wherein the footwear unit according to the invention comprises, as functionally coherent or functionally mutually associated components, an article of footwear on the one hand and an inner shoe material on the other, wherein the inner shoe material in particular is configured in the form of a sock or a stocking.

Moreover, the present invention relates to a method for equipping an article of footwear with an in particular modular protective function against radioactive, chemical and/or biological toxic and/or harmful substances and a method for providing a functional footwear unit that is preferably equipped with an in particular modular protective function against the aforementioned toxic and/or harmful substances. In this connection, the present invention also relates to a method for prolonging or increasing the protective function of an article of footwear as such.

The present invention also relates to a use of an inner shoe material containing at least one adsorptive material for equipping a functional footwear unit with the above-mentioned particularly modular protective function or for prolonging or increasing the protective function of an article of footwear against radioactive, chemical and/or biological toxic and/or harmful substances.

In general, chemical, biological and nuclear toxic or harmful substances, in particular warfare agents, constitute a severe potential hazard for persons coming into contact with such substances, such as e.g. soldiers in combat and persons engaged in risk protection such as firefighters or the like. In this case, even small amounts or concentrations of the toxic or harmful substances in question often cause lasting health impairment and are even fatal to persons who come into contact with such substances or are confronted with them.

There are a number of highly toxic substances or materials that are absorbed on contact with the skin, and even in small amounts or concentrations, cause severe and sometimes irreversible bodily injury. Particular examples in the area of chemical toxic or warfare agents include sulfur mustard (mustard gas) and the neurotoxin sarin. Persons at risk of being exposed to such highly toxic poisons must therefore wear suitable protective clothing or be protected against these substances or toxins by suitable protective materials or equipment.

This also generally applies to biological warfare or toxic agents, such as bacteria, viruses or toxins of biological origin, which also lead to lasting health impairment on contact.

Moreover, direct contact or contamination with radioactive substances, in particular also in the form of radioactive particles or the like, is also to be avoided, because they can sometimes cause long-term and lasting damage to health.

In the area of risk prevention, for example in major fires such as in chemical production facilities or the like, numerous sometimes highly toxic substances can also be released, so that persons engaged in the area of risk prevention, such as e.g. firefighters who may come into contact with such toxic substances, must also be correspondingly protected. In this connection, so-called TICs (toxic industrial compounds) can also play a decisive role as hazardous substances.

Concerning the risk arising from toxic or harmful substances, there is also a great potential risk to the extremities, particularly the lower extremities. In this connection, one should focus in particular on the area of the foot and the transition area between the foot and lower leg, because the above-mentioned areas of the body, or the clothing worn on these areas such as footwear, are sometimes in long-term contact with toxic or harmful substances present in the floor area in high concentrations, resulting in a high risk of contamination or poisoning.

Consequently, one must be particularly careful to ensure that the feet, the transition areas between the feet and lower leg, and the calf itself are sufficiently protected against toxic substances. For this purpose, corresponding (protective) footwear is generally used. In this case, it should also be borne in mind that in addition to its protective function against the above-mentioned toxic or harmful substances, the (protective) article of footwear should also show high mechanical stability, high wearing comfort and optionally also fire or flame resistance, which, however, is not always the case in the prior art.

In this connection, for example, overshoes are used according to the prior art that as such have a certain protective function against the toxins or harmful substances in question and which are pulled over the actual article of footwear during use. However, such a design is also accompanied by the drawbacks specific to the application, as optimum handling is not always ensured, in particular with respect to pulling on and off of the overshoe. If the overshoe is put on too late, the article of footwear is already contaminated, so that optimum protection is then no longer provided and both the overshoe and the article of footwear must also be decontaminated or disposed of. In addition, the article of footwear is burdened with additional weight, thus reducing wearing comfort, and for this reason as well, the overshoe is not suitable for long-term wear. In particular, it is not possible to effectively seal the transition area of the overshoe, and this also applies to the transition to a protective suit in the area of the lower leg.

Moreover, footwear is also known in the prior art wherein in order to provide a certain degree of protection against toxic or warfare agents, an adsorptive material is permanently integrated into the article of footwear itself or constitutes a fixed and permanent component of the article of footwear.

DE 3132324 A1 thus relates to a water and air-tight and moisture-conducting textile material with a water vapor-permeable textile carrier that is sealed with a closed layer of a hydrophilic polymer, wherein the water vapor-permeable layer or coating comprises activated carbon as protection against warfare agents, and wherein the activated carbon is incorporated into the coating material. In this case, the described textile material can be used as an upper for shoes or footwear.

The footwear described in the prior art having permanently integrated components in order to ensure a certain protective function against toxic or harmful substances generally has the drawback that the wearing comfort is not always optimal, and in the case of contamination, the article of footwear as a whole must either be regenerated in a complex process or replaced and disposed of, which also results in high costs and corresponding logistical expense. In addition, the protective performance of the protective systems known in the prior art is not always optimal, wherein it is also impossible to adapt the protective performance.

Moreover, footwear of the prior art having a corresponding protective function is sometimes problematic because, for example, in the case of high exposure to the underlying toxic or harmful substances, in particular if drops of a liquid toxic or harmful substances falls from a great height onto the material, toxic substances that penetrate the footwear unit come into direct contact with the foot of the wearer, which results in corresponding contamination, with the harmful substances being absorbed by the wearer of the article of footwear.

Moreover, stocking, keeping, or storage of footwear of the prior art with permanently integrated protection against toxic or harmful substances is also complex and cost-intensive, as the entire article of footwear must be inserted or sealed in a package that protects against premature wearing out of the protective components or elements. In particular, in the footwear of the prior art, the fact is not taken into account that the solid components of the article of footwear have different shelf lives. The shelf life is thus substantially restricted by the limited durability of connection of the sole (delamination of the shoe sole), so that after the maximum shelf life is exceeded, the entire article of footwear with the still intact protective elements or components must be disposed of, which is also costly and associated with corresponding logistical expense.

Accordingly, for the shoe systems of the prior art with integrated protection against toxic and/or warfare agents, in the event of contamination of the article of footwear or depletion of the adsorbent agent, the entire article of footwear must be replaced or regenerated at great expense.

BRIEF SUMMARY OF THE INVENTION

Against this background, the object of the present invention therefore lies in the provision of a footwear unit that at least largely prevents or at least alleviates the above-described drawbacks of the prior art. In particular, the footwear unit is to show a prolonged or improved protective function against chemical or biological or nuclear toxic and/or harmful substances, wherein the footwear unit is to be suitable for military use or use in the area of risk prevention.

A further object of the present invention is to be seen as providing a corresponding footwear unit that is improved in its use and handling properties compared to the footwear of the prior art, wherein in this connection, handling in the event of contamination as well as keeping or storage properties are to be improved in order thus to provide a cost-efficient and high-performance system.

Moreover, another further object of the present invention is to be seen as providing a footwear unit in which the protective function can be individually adjusted or tailored, so to speak, with respect to the background of the respective field of use, wherein the footwear unit should simultaneously ensure high wearing comfort. In particular, protective performance should be further improved compared to the systems of the prior art.

In order to achieve the above-described object, the present invention thus proposes—according to a first aspect of the present invention—a functional footwear unit, in particular in the form of a kit (kit of parts), preferably with an in particular modular protective function against chemical or biological or nuclear toxic and/or harmful substances is disclosed; respective advantageous improvements and embodiments of this aspect of the invention are further disclosed.

The present invention further relates—according to a second aspect of the present invention—to a method for equipping an article of footwear, in particular in the form of a shoe or preferably a boot, with an in particular modular protective function against chemical or biological or nuclear toxic and/or harmful substances, such as disclosed herein; further, in particular advantageous embodiments of the method according to the invention are also provided.

Moreover, the present invention also relates—according to a third aspect of the present invention—to a method for providing a functional footwear unit pertaining to the method according to this aspect of the invention; further, in particular advantageous embodiments of the method according to the invention according to this aspect are the subject matter of this disclosure.

The present invention further relates—according to a fourth aspect of the present invention—to a method for prolonging or increasing the protective function of an article of footwear; further, in particular advantageous embodiments of the method are disclosed.

The present invention further relates—according to a fifth aspect of the present invention—to a use of an inner shoe material containing at least one adsorptive material, in particular in the form of a sock or preferably a stocking, for equipping a functional footwear unit with an in particular modular protective function against the toxins or harmful substances in question; further, respective advantageous improvements and embodiments of this aspect of the invention are further disclosed.

Finally, subject matter of the present invention—according to a sixth aspect of the present invention—is a use of an inner shoe material containing at least one adsorptive material for prolonging or increasing the protective function of an article of footwear; further, respective advantageous improvements and embodiments of this aspect of the invention are provided.

It is self-evident that in the following description of the present invention, such embodiments, configurations, advantages, examples or the like which in the following—in order to avoid unnecessary repetitions—are explained with respect to only one aspect of the invention, of course also apply to the other aspects of the invention, without this having to be expressly stated.

Moreover, it is self-evident that in indications of values, figures, and areas in the following, the respective values, figures, and areas indicated are not to be understood as limitative; it self-evident to the person skilled in the art that deviations can be made from the areas or data indicated with respect to individual cases or applications without departing from the scope of the present invention.

In addition, it also applies that in principle, all of the values or parameters and the like indicated in the following can be arrived at or determined by normalized or standardized determination methods, or also by other determination or measurement methods known in this field to the person skilled in the art. Unless otherwise indicated, the basic values or parameters are determined under STP conditions (i.e. in particular at a temperature of 20° C. and/or a pressure of 1,013.25 hPa or 1.01325 bar).

Moreover, it is to be taken into account in all relative or percentage amounts given below, in particular those related to weight, that these indications are to be selected or combined in the context of the invention by the person skilled in the art in such a manner that they amount in total—optionally including further components or ingredients, in particular as defined in the following—to 100% or 100 wt % in all cases. However, this is self-evident to the person skilled in the art.

This having been said, the present invention is described and explained in further detail in the following, specifically by means of drawings or figures illustrating embodiments or examples according to the invention.

In the context of the explanation of these preferred embodiments or examples of the present invention, which, however, are by no means limitative with respect to the present invention, further advantages, properties and features of the present invention will also be presented.

The subject matter of the present invention—according to a first aspect of the present invention—is therefore a functional footwear unit, in particular in the form of a kit (kit of parts), preferably with an in particular modular protective function against radioactive toxic or harmful substances and/or against chemical and/or biological toxic or harmful substances, in particular warfare agents, wherein the footwear unit comprises, as functionally coherent or functionally mutually associated, but disconnected and/or separate, in particular spatially separate components:

(A) an article of footwear, in particular in the form of a shoe or preferably a boot, on the one hand and (B) an inner shoe material (foot covering material) comprising at least one adsorptive material, in particular in the form of a sock or preferably a stocking, preferably for prolonging and/or increasing the protective function of the article of footwear, on the other.

Quite surprisingly, the applicant found that by selectively combining at least one inner shoe material or foot covering material comprising at least one adsorptive material, which in particular is configured in the form of a sock or preferably a stocking, with an article of footwear configured in the form of a shoe or preferably a boot, as a whole, a functional footwear unit is provided according to the invention that shows a particularly modular protective function against radioactive, chemical or biological toxic or harmful substances, wherein the functional footwear unit according to the invention provided in this manner has improved properties of application, use, or handling with a simultaneously strong protective function against the toxins or harmful substances in question.

In this connection, a central idea of the present invention is that the article of footwear on the one hand and the inner shoe material or foot covering material comprising the adsorptive material on the other are present, with respect to the footwear unit provided according to the invention, in the form of components that are functionally coherent or functionally mutually associated, but in particular are disconnected or separate, particularly spatially separate, in particular when the footwear is not being worn.

Therefore, the concept according to the invention is that in particular, a functional footwear unit with two components—an article of footwear on the one hand and at least one inner shoe material comprising an adsorptive material on the other—is provided, wherein during wear or use, the inner shoe material is arranged or worn in particular in the form of a sock or preferably a stocking under the article of footwear as such and consequently is covered or enclosed from outside, so to speak, by the article of footwear arranged on top of the inner shoe material, wherein the components then operate during use (i.e. in particular during wear) as a functional unit that is functionally coherent and self-complementing regarding its respective (protective) properties.

In this connection, as explained in detail below, the article of footwear as such can also be equipped with a protective function against chemical or biological or nuclear toxic or harmful substances that functionally interacts with the protective function provided by the inner shoe material, such that the respective components (i.e. the article of footwear on the one hand and the inner shoe material on the other) further complement each other with respect to their protective function against toxic and harmful substances. In this case, the (protective) properties of the footwear unit according to the invention can be selectively adjusted or tailored overall by means of the specific configuration and coordination of the components. In this connection, based in the context of the present invention on the article of footwear, for example, strong mechanical protection or a strong protective function against mechanical force can be provided together with basic protection against toxic or harmful substances, said protection being functionally complemented or selectively increased by the additional protective function of the inner shoe material against the above-mentioned toxic or harmful substances.

The underlying concept of the present invention, according to which a functional footwear unit with a modular structure is provided based on a special article of footwear on the one hand and a special inner shoe material on the other, is also advantageous in that in the case of contamination, the respective components can be regenerated separately or independently of one another or disposed of independently of one another. For example, it can be provided according to the invention that the inner shoe material, in the event that its adsorptive material is worn out, can be regenerated or also disposed of or replaced. In this case, complex regeneration and also disposal of the article of footwear can be dispensed with, as the inner shoe material does not come into direct contact with the wearer because of the presence of an inner shoe material that is to be individually handled and replaced, so that there is no risk from a possibly contaminated article of footwear. The separate handling of the components results in improved application properties with simultaneously optimized logistics (optimized procurement or storage because of smaller quantities of the article of footwear) and thus in reduced costs.

In particular, an article of footwear that is already broken in and individually adapted to the wearer based on the concept according to the invention can provide or acquire a complete protective function when the inner shoe material alone is replaced or regenerated, so that breaking in of new boots (formation of abrasion and pressure points and blister formation), which is uncomfortable and can impair performance, can be dispensed with. In particular, increased mechanical stress and damage to materials arranged between the shoe and shoe wearer resulting from footwear that has not been broken in can be prevented.

In addition, the components on which the footwear unit according to the invention is based, in the form of the article of footwear on the one hand and the inner shoe material on the other, can be stored or provided separately, which also correspondingly takes into account the various shelf lives or the accompanying possible storage times of the basic components. In this connection, storage of the respective components can also be individualized and thus optimized with respect to the individual storage requirements of the components. In this connection in particular, insertion of the article of footwear, which generally does not contain any adsorptive material having a tendency to wear out, into a protective (anti contaminant) shell ("welding in") can be dispensed with, thus making it possible to limit corresponding storage of the inner shoe material containing the adsorptive materials.

According to the invention, by means of providing a modular protective function against toxic or harmful substances, in particular warfare agents, a functional footwear unit is provided overall in which the respective protective properties of the basic components in the form of the article of footwear on the one hand and the inner shoe material on the other complement each other beyond the capacity of the individual components, making it possible overall to thereby provide an individually adaptable and tailor-made protective function.

In particular, it is also ensured in the context of the present invention that in the event of penetration of any toxic substances through the article of footwear, as can occur for example in the case of extremely high or long-lasting exposure to toxic or harmful substances, these can be taken up or absorbed by the inner protective material so that they cannot penetrate to the wearer of the footwear unit according to the invention.

In general, any contamination can generally be reduced by using the special article of footwear as such, as any toxic or harmful substances coming into contact with the footwear unit according to the invention can already be prevented from reaching the wearer by the article of footwear, wherein this protective action of the article of footwear is complemented by the inner shoe material as a form of reserve protection, so to speak.

The functional footwear unit according to the invention also provides improved wearing comfort, as due to its mutually complementary protective properties, it is possible to configure the materials such that, for example, they are thinner and/or have a lighter weight per unit area. As the inner shoe material as such already provides high wearing comfort with respect to its properties as a lining material because of its special structure, one can for example correspondingly reduce or even dispense with the inner layer or the layer of the article of footwear facing the wearer during use.

Moreover, with respect to the functional footwear unit according to the invention, the article of footwear on the one hand and the inner shoe material on the other can be coordinated with each other in their respective structure or manufacture, for example with respect to the course of seams or the like, thus making it possible to avoid pressure points or the like.

According to the invention, the term "functionally coherent and/or functionally mutually associated components" is to be understood quite broadly. In particular, this term indicates that the properties on which the respective components of the footwear unit are based complement or interact with one another, in particular with respect to the provision of a corresponding protective function against the toxins or harmful substances in question, in particular warfare agents, wherein the underlying properties can be individually adjusted or tailored because of the modularity by means of special configuration and coordination of the components in the form of the article of footwear and the inner shoe material.

In this connection, the term "modular," as used in particular according to the invention with respect to provision of the protective function, is also to be understood in particular such that according to the invention, a modularized structure or a modularized combination, with the provision of separate components or individual components in the form of the article of footwear on the one hand and the inner shoe material on the other, is provided in order to obtain the functional footwear unit with its mutually complementary protective properties.

The term "inner shoe material" (also referred to synonymously as the "foot covering material"), as used in the context of the present invention, is to be understood in particular as referring to a sock or preferably a stocking. In particular, during wear or use, the inner shoe material can accommodate the foot of a user or wearer and cover or enclose it in a manner that is at least essentially complete, wherein the inner shoe material can lie directly against the foot. In the same manner, the inner shoe material can also cover a lower section of the calf facing towards the foot.

In this connection, the term "article of footwear", as is used in the context of the present invention, is in particular further to be understood as meaning that this is in particular a shoe or a boot that in turn can cover or enclose the inner shoe material and which functions during wear in particular as an outer covering facing towards the toxic or harmful substances.

Further advantages, features, properties and aspects of the present invention can be found in the following description of preferred embodiments by means of the drawings. The figures show the following:

DETAILED DESCRIPTION OF THE INVENTION

Figure 1:
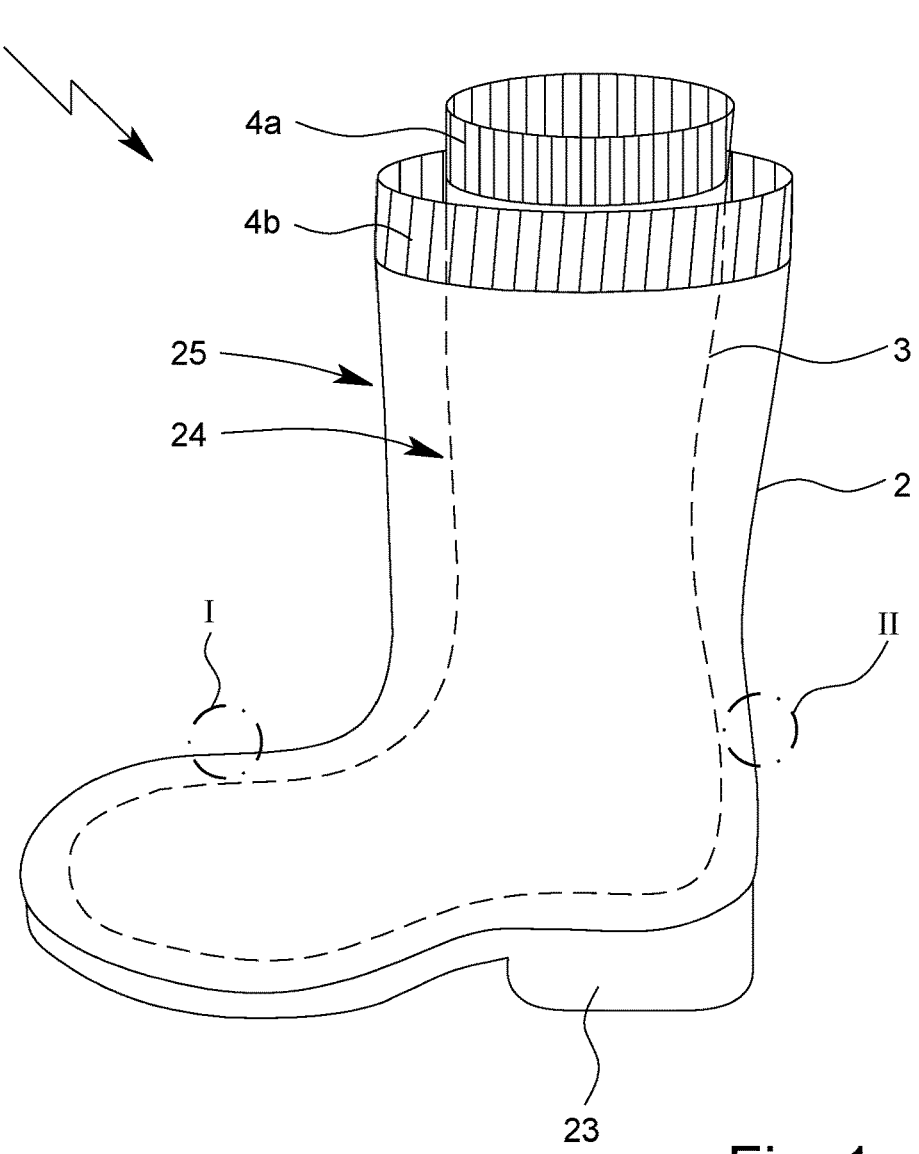
FIG. 1 provides a diagrammatic view of the functional footwear unit according to the invention, with an article of footwear on the one hand and an inner shoe material (foot covering material) that is arranged separately in the article of footwear during use or wear, in particular in the form of a sock or preferably a stocking, on the other.

FIG. 1 shows a functional footwear unit 1 according to the invention, which in particular is in the form of a kit (kit of parts), wherein the functional footwear unit 1 according to the invention is preferably equipped with an in particular modular protective function against radioactive toxic or warfare agents and/or against chemical and/or biological toxic or harmful substances, in particular warfare agents. The functional footwear unit 1 according to the invention is therefore characterized in that the footwear unit 1 comprises, as functionally coherent or functionally mutually associated, but disconnected or separate, in particular spatially separate components, on the one hand (A) an article of footwear 2, in particular in the form of a shoe or preferably a boot, and on the other (B) an inner shoe material (foot covering material) 3, comprising at least one adsorptive material 14, and in particular in the form of a sock or preferably a stocking, preferably for prolonging or increasing the protective function of the article of footwear 2. FIG. 1 illustrates in particular the functional footwear unit 1 according to the invention during wear or use, according to which the inner shoe material 3 is accommodated by the article of footwear 2.

In the context of the present invention, it is preferred in particular that the footwear unit 1 according to the invention is equipped with a protective function against radioactive toxic or harmful substances and/or against biological toxic or harmful substances and/or against chemical toxic or harmful substances. The footwear unit 1 according to the invention thus provides extensive protection against the widest variety of toxic or harmful substances, which is achieved in particular through the selective interaction of the article of footwear 2 on the one hand and the inner shoe material 3 on the other, according to which the respective protective properties can in particular complement one another. In this connection in particular, it is possible according to the invention to adapt or tailor the required profile of the respective protective function through specific configuration and coordination of the components on which the functional footwear unit 1 is based with respect to the article of footwear 2 on the one hand and the inner shoe material 3 on the other.

For example, it can be provided in a non-limiting manner that the article of footwear 2 already has a protective function against the toxins or harmful substances in question based on barrier properties, wherein the barrier function, as described in detail below, can be provided for example through the selective use of a (barrier layer) membrane or by specially equipping the surface of the article of footwear 2 with harmful-substance-resisting properties, while the inner shoe material 3 has a supplementary (reserve) protective action based on adsorptive properties of the inner shoe material 3 as a result of the use of an adsorptive material.

In particular, it is provided according to the invention that in particular during use, the inner shoe material 3 is not permanently connected to the article of footwear 2 or that the inner shoe material 3 is not a permanent component of the article of footwear 2. In particular, in the context of the present invention, the inner shoe material 3, in particular during wear or use, lies loosely or in an unconnected manner on the article of footwear 2, or the article of footwear 2, in particular during wear or use, lies loosely or in an unconnected manner on the inner shoe material 3.

In other words, the components used according to the invention for the functional footwear unit 1 are separate and physically independent components, which can be present separately from one another, so to speak, in particular when the unit is not being used. In this case, provision of the functional footwear unit 1 in the form of the respective components gives rise, as it were, to the modularity of the footwear unit 1 according to the invention. As mentioned above, the advantages accompanying this are in particular that on the one hand, the protective function provided by coordination of the components can be supplemented in modular fashion or individually adapted, wherein the respective components can be easily exchanged or replaced in the case of loss of functionality or contamination. On the other hand, the design according to the invention, which is based on modularity, leads to improved use and handling properties, in particular as the respective components can be put on or worn like conventional footwear or conventional inner shoe materials, in particular with respect to the configuration in the form of a sock or a stocking. Moreover, logistics and storage are also improved, because as mentioned above, the respective components can be handled or stored separately from one another, which accordingly reflects the corresponding specific properties of the components.

Quite surprisingly, the applicant found in this connection that the protective performance of the system as a whole and thus the footwear unit 1 according to the invention is further improved by means of the separate configuration of the article of footwear 2 on the one hand and the inner shoe material 3 on the other, which lie against each other during wear or use in a loose or disconnected manner. Without wishing to limit ourselves to this theory, the loose arrangement of the components sometimes results in a small air gap between the article of footwear 2 on the one hand and the inner shoe material 3 on the other, leading to improved convection of the air to be purified, accompanied by improved utilization of the adsorptive material 14 of the inner shoe material 2 with respect to the toxic or harmful substances to be adsorbed.

As a result of the modular structure of the functional footwear unit according to the invention 1, according to which the inner shoe material 3, in particular in the form of a sock or a stocking, already shows a strong protective function due to the use of an adsorptive material 14, numerous physical or design embodiments in particular can be implemented for the article of footwear 2. For example, in a non-limitative manner, the article of footwear 2 can be in the form of a water vapor-permeable or breathable lace-up boot or shoe. In this connection, the article of footwear 2 can be further optimized, in particular with respect to wearing comfort and convenience, for example with respect to the use of (shoe) seams.

In particular, it is provided according to the invention that the inner shoe material 3 is provided for arrangement, in particular during wear or use, on the inside of the article of footwear 2, as shown in FIG. 1. In particular, the inner shoe material 3 is provided for arrangement during wear between the article of footwear 2 and the area of the foot to be protected. In particular, the inner shoe material 3 can be provided for arrangement on the side of the article of footwear 2 turned towards the area of the foot to be protected during wear.

In this connection, it is provided in particular according to the invention that the inner shoe material 3, so to speak, fully or completely covers or encloses the foot area, i.e. the foot as such (with the associated toe, sole, heel, and instep areas). In particular, the inner shoe material 3 can also cover the area of the ankle and the area in particular of the lower calf (leg shaft). As mentioned above, the inner shoe material 3 can be configured in particular in the form of a sock or preferably a stocking, which also entails that the inner shoe material 3 lies during wear or use closely against the body areas or the foot and lower leg area to be covered, which is advantageous with respect to wearing comfort and convenience on the one hand and the provision of an effective protective function on the other.

Further with respect to the article of footwear 2 of the footwear unit 1 according to the invention, it can be provided for arrangement, in particular during wear or use, on the outer side of the inner shoe material 3, as likewise shown in FIG. 1. In particular, the article of footwear 2 can be provided for arrangement on the side of the inner shoe material facing away from the foot area to be protected during wear 3. In this connection, in addition to its supplementary protective function against the toxic or harmful substances in question, the article of footwear 2 also provides in particular mechanical protection against external mechanical effects.

Figure 2:
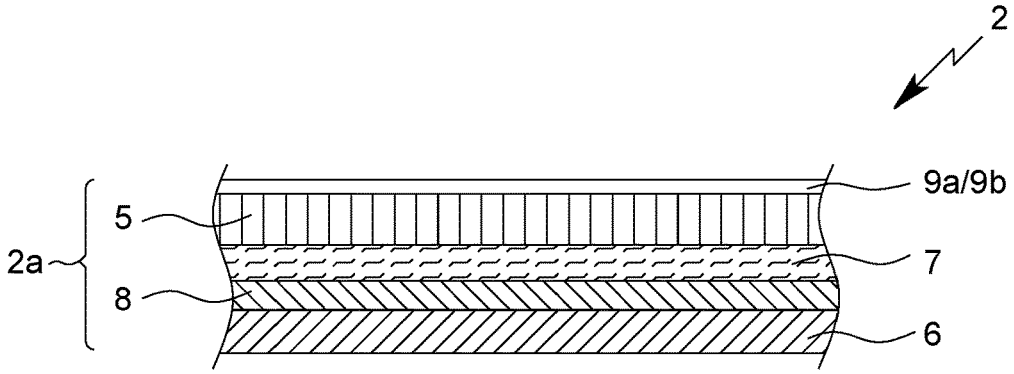
FIG. 2 provides a diagrammatic sectional view in the form of a sectional enlargement of FIG. 1 (section I of said figure) through the layer structure of an article of footwear on which the functional footwear unit is based according to a preferred embodiment of the invention, according to which the article of footwear as such comprises an additional membrane.

In the following, the article of footwear 2 as such is described in further detail:

As shown in particular in FIG. 2, the article of footwear 2 can comprise a multilayer, in particular laminate-type structure 2*a*. In this connection, the article of footwear 2 can be configured according to a preferred embodiment of the invention in multiple layers, in particular in the form of a laminate 2*a*. In particular, the article of footwear 2 can comprise or be composed of a multilayer material 2*a*.

According to the invention, it is provided in particular in this connection that, as shown in FIG. 2, the individual layers 5, 6, 7, 8, 9 of the multilayer structure 2*a* or the laminate 2*a* or the multilayer material 2*a* in particular are connected to one another sectionally or in particular over their entire surface. In particular, the individual layers 5, 6, 7, 8, 9 of the multilayer structure 2*a* or the laminate 2*a* or the multilayer material 2*a* can form a composite. This is conducive in particular to the mechanical stability of the article of footwear 2. By selecting and coordinating the respective layers of the multilayer structure, as described below in particular, the properties of the article of footwear 2 can be preset or adjusted, specifically with respect to coordination with the inner shoe material 3.

In particular, the respective layers 5, 6, 7, 8, 9 can be connected to one another, for example by methods known per se for this purpose (e.g. by gluing, welding, riveting, stapling etc.). Advantageously, connecting or fixing of the individual layers 5, 6, 7, 8, 9 of the layered structure to one another takes place seamlessly, preferably without damaging the individual layers (e.g. by gluing, welding etc.). For the case of stitching or the like, it can also be provided that the seams are correspondingly sealed, which can be carried out using a so-called seam sealing strip.

It can also be provided according to the invention that the article of footwear 2, in particular the multilayer structure 2*a* or the laminate 2*a* or the multilayer material 2*a*, is configured to be water-impermeable and/or air-impermeable, but also water vapor-permeable. In particular, the article of footwear 2, in particular the multilayer structure 2*a* or the laminate 2*a* or the multilayer material 2*a*, can be configured to be breathable. According to a preferred embodiment according to the invention, it can also be provided that the article of footwear 2, in particular the multilayer structure 2*a* or the laminate 2*a* or the multilayer material 2*a*, is configured to be extensible and/or elastic (in particular reversibly extensible) and/or stretchable in at least one direction to at least 5%, preferably to at least 10%, based on the length and/or width of the article of footwear 2, in particular of the multilayer structure 2*a* and/or laminate 2*a* and/or multilayer material 2*a* in an unstretched state, which is also conducive to wearing comfort.

As shown in FIG. 2, it is provided in particular according to the invention that the article of footwear 2, in particular the multilayer structure 2*a* or the laminate 2*a* or the multilayer material 2*a*, comprises at least one outer or covering layer 5. In this connection, it is provided in particular that the outer or covering layer 5, in particular during wear or use, is arranged on the outer side of the article of footwear 2. In addition, the outer or covering layer 5 can be provided in particular on the side of the article of footwear 2 facing away from the foot area to be protected during wear.

In particular, the outer or covering layer 5 can be configured as a continuous, in particular break or perforation-free and/or closed layer. This ensures in particular that in addition to the mechanical stability provided by the outer or covering layer 5, a certain protective function against the toxins or harmful substances in question is already provided, in particular if the outer or covering layer 5 is further surface-treated, as explained in particular below.

In this connection, it can be provided according to the invention that the outer or covering layer 5 comprises or is composed of leather or a plastic, preferably leather. In particular, the use of leather provides high mechanical stability with simultaneously favorable wearing comfort.

Further with respect to the outer or covering layer 5, this can generally comprise or be composed of a material selected from the group of leather; rubbers, in particular chloroprene rubbers, preferably neoprenes, and fluororubbers; rubber, in particular silicone rubber, fluorine rubber, butyl rubber, urethane rubber, and preferably butyl rubber; plastics, in particular aramids, polyamides and halogenated plastics; and mixtures and combinations thereof. As mentioned above, according to a preferred embodiment of the invention, the outer or covering layer 5 can comprise or be composed of leather.

According to an alternative embodiment of the present invention, it can also be provided that the outer or covering layer 5 is configured as a two-dimensional textile sheet material, in particular in the form of a woven fabric. In this connection, the outer or covering layer 5 can contain or be composed of at least one preferably flame-retardant fiber material, preferably selected from the group of aramid fibers; polyamide fibers, in particular nylon; fibers with a high halogen content; polyalkylene fibers, in particular polyethylene fibers, preferably fibers of ultra-high-molecular-weight polyethylene (UHMW-PE); and mixtures and combinations thereof.

With respect to the outer or covering layer 5, this can have a weight per unit area in the range of 50 g/m$^2$ to 2,000 g/m$^2$, in particular 100 g/m$^2$ to 1,500 g/m$^2$, preferably 150 g/m$^2$ to 1,000 g/m$^2$, and preferably 200 g/m$^2$ to 750 g/m$^2$.

With respect to the thickness of the material of the outer or covering layer 5, this can vary over a wide range. However, it is preferred according to the invention to provide a thickness of the outer or covering layer 5 in the range of 0.5 to 5 mm, preferably 1 mm to 4 mm, and preferably 1 mm to 3 mm.

The article of footwear 2, in particular the multilayer structure 2*a* or the laminate 2*a* or the multilayer material 2*a*, can also comprise at least one inner layer (FIG. 2). In this case, the inner layer 6, in particular during wear or use, can be provided on the inside of the article of footwear 2. In particular, the inner layer 6 can be provided on the side of the article of footwear facing the foot area to be protected during wear 2. In particular, the inner layer 6 can be an inner shoe lining.

Further with respect to the inner layer 6, this can be configured as a two-dimensional textile sheet material, in particular in the form of a woven fabric, knit fabric, crocheted fabric, laid fabric, composite nonwoven fabric or nonwoven fabric, in particular in the form of a woven fabric, knit fabric and/or nonwoven fabric. In this connection, the weight per unit area of the inner layer 6 can vary over a wide range.

Because of the modular structure of the footwear unit 1 according to the invention, with the use of a special inner shoe material 3, the inner layer 6 of the article of footwear 2 can have only a low weight per unit area or even be dispensed with completely, as the function of a lining material can already be provided by the inner shoe material 3. In particular, the inner layer 6 can have a weight per unit area in the range of 10 g/m$^2$ to 500 g/m$^2$, in particular 25 g/m$^2$ to 400 g/m$^2$, preferably 50 g/m$^2$ to 300 g/m$^2$, and preferably 75 g/m$^2$ to 200 g/m$^2$.

Moreover, the inner layer 6 can comprise or be composed of at least one fiber material selected from the group of natural substances and synthetic substances, in particular silk, cotton, wool, linen, elastane, modacrylic, aramid, in particular meta-aramid, and mixtures and combinations thereof. In general, air-permeable textile materials can be used for the inner layer 6. In particular, the inner layer can comprise oleophobic and/or hydrophobic equipment and/or a flame-retardant coating, in particular as described in the following for the layer 9.

According to a preferred embodiment according to the invention, the article of footwear 2 can further comprise a membrane 7 as shown in FIG. 2 and in particular as specified below:

As mentioned above, the article of footwear 2, in particular the multilayer structure 2*a* or the laminate 2*a* or the multilayer material 2*a*, can comprise at least one membrane 7. In this connection, the membrane 7 can be arranged in particular between the outer or covering layer 5 and the inner layer 6 (FIG. 2).

In particular, the membrane 7 can be configured to be water-impermeable or air-impermeable. In addition, the membrane 7 should be at least essentially impermeable, in particular to chemical or biological or nuclear toxic or harmful substances. The membrane 7 thus performs the function of a barrier layer against the toxic or warfare agents, so that in this manner, the article of footwear 2 as such is already provided with improved protective properties.

Because of this special property of the membrane 7, it is ensured according to the invention that any toxic or harmful substances that penetrate through the outer or covering layer 5 of the shoe material 3 are already retained by the membrane 7 and thus prevented from penetrating further. This also causes the burden on the adsorptive material 14 of the inner shoe material 3 to be reduced, as the toxic or harmful substances in question either do not reach the adsorptive material 14 or reach it only in extremely small quantities, with the result that through additional use of a membrane 7, one achieves a double protective function, so to speak, of the footwear unit 1 according to the invention against harmful substances, said function being provided by means of the barrier action of the membrane 7 and the adsorptive action of the adsorptive material 14.

Further concerning the optionally present membrane 7, this can be a continuous, in particular closed or possibly microporous membrane 7. In particular, the membrane 7 can have a thickness in the range of 1 μm to 500 μm, in particular 1 μm to 250 μm, preferably 1 μm to 100 μm, preferably 1.5 μm to 50 μm, particularly preferably 2.5 μm to 30 μm, and most particularly preferably 5 μm to 25 μm.

The optionally provided membrane 7 should at most be only slightly swellable or capable of absorbing water; in particular, the membrane 7 should have a swellability or a water absorption capacity of at most 35%, in particular at most 25%, based on the net weight of the membrane 7. In addition, the membrane 7 should comprise no or essentially no strongly hydrophilic groups, in particular no hydroxyl groups. For the purpose of at most slight swelling, however, the membrane 7 can comprise weakly hydrophilic groups, in particular polyether groups.

In order to increase wearing comfort or achieve favorable wear resistance, it is advantageous if the membrane 7 is configured to be extensible or stretchable in at least one direction, in particular in the longitudinal and/or width direction, to at least 10%, in particular to at least 20%, and preferably to at least 30%, based on the length and/or width of the membrane 7 in an unstretched or non-stretched state.

According to the invention, it is advantageous if the membrane 7 comprises a plastic or a polymer or is composed thereof. In particular, the plastic or the polymer can be selected from the group of polyurethanes, polyether amides, polyester amides, polyether esters, polytetrafluoroethylenes and/or cellulose-based polymers and derivatives of the above-mentioned compounds, preferably polyether esters and polytetrafluoroethylenes.

Similarly, it can be provided according to the invention that the membrane 7 is applied to, in particular laminated or layered onto, a membrane carrier layer (not shown). In this connection, the membrane carrier layer can in particular be an air-permeable two-dimensional textile sheet material, in particular selected from the group of woven fabrics, knit fabrics, crocheted fabrics, laid fabrics, textile composites and non-woven fabrics. In this connection, the membrane can be fixed in particular, by means of an adhesive applied preferably in a punctate manner, to the membrane carrier layers. The stability of the membrane can be increased by using a membrane carrier layer because, without wishing to limit ourselves to this theory, the flat carrier layer basically acts as a supporting layer for the membrane 7, which increases the mechanical stability and the tear resistance of the membrane.

Moreover, the membrane 7 can have a water vapor permeability at 25° C. and a thickness of 50 μm of at least 12.5 $l/m^2$ per 24 h, in particular at least 17.5 $l/m^2$ per 24 h, preferably at least 20 $l/m^2$ per 24 h or more, measured by the "inverted cup method" according to ASTM E 96 at 25° C. For further details on measurement of water vapor permeability [water vapor transmission, WVT], reference can be made to McCullough et al. "A comparison of standard methods for measuring water vapor permeability of fabrics" in Meas. Sci. Technol. [Measurements Science and Technology] 14, 1402-1408, August 2003. In this manner, particularly high wearing comfort is ensured.

In this connection, the membrane 7 can have a water vapor transmission resistance $R_{et}$ under stationary conditions, measured according to DIN 31 093:1993 of February 1994 or according to the international standard Norm ISO 11092 and at 35° C., of at most 25 $(m^2 \cdot Pa)/W$, in particular at most 20 $(m^2 \cdot Pa)/W$, and preferably at most 13 $(m^2 \cdot Pa)/W$, with a thickness of 50 μm. The water vapor transmission resistance $R_{et}$ can be measured or determined in particular according to DIN 31 093: 1993 of February 1994, "Textilien—Physiologische Wirkungen, Messung des Wärme-und Wasserdampfdurchgangswiderstandes unter stationären Bedingungen [Textiles—Physiological actions, measurement of thermal and water vapor transmission resistance under stationary conditions] (sweating guarded-hotplate test)."

As also shown in FIG. 2, it can also be provided according to the invention that the article of footwear 2 comprises a spacing layer 8. In this connection, the spacing layer 8 can be arranged between the inner layer 6 and the outer or covering layer 5 or between the inner layer 6 and the membrane 7. The spacing layer 8 can in particular be configured in the form of a web (nonwoven), a foam layer or a textile sheet material, in particular a woven fabric or knit fabric, preferably a knit fabric. In this case, the weight per unit area of the spacing layer 8 can be in the range of 5 $g/m^2$ to 150 $g/m^2$, in particular 10 $g/m^2$ to 125 $g/m^2$, preferably 15 $g/m^2$ to 100 $g/m^2$, and preferably 20 $g/m^2$ to 75 $g/m^2$. The optionally present spacing layer 8 serves in particular to provide further mechanical stabilization of the material. In particular, the spacing layer 8 can absorb and attenuate mechanical stresses. In addition, the spacing layer 8 further improves wearing comfort.

According to the invention, it can also be provided that the article of footwear 2 comprises an oleophobic and/or hydrophobic agent or layer 9, as shown in FIG. 2, in particular in order to further increase the protective function of the article of footwear 2.

In this connection, the oleophobic and/or hydrophobic agent or layer 9 can preferably be provided on or applied to the side of the article of footwear 2 facing the toxic or harmful substances during wear, as also shown in FIG. 2. The oleophobic and/or hydrophobic agent or layer 9 can in particular be provided on or applied to the side of the article of footwear 2 facing away from the area of the foot to be protected during wear. Because the article of footwear 2 is specially equipped with oleophobic or hydrophobic properties, the protective function of the article of footwear 2 as such is further increased, as the article of footwear 2 shows a stronger barrier or repellent function with respect to organic substances in particular. By selectively subjecting the article of footwear 2 to oleophobic and/or hydrophobic treatment, one can thus ensure to a certain extent that in particular organic substances that are present in liquid form during use or wear cannot or at least essentially cannot penetrate into the article of footwear 2, so that a large portion of the toxic substances impinging on the material is retained on the surface in liquid form, thus beading directly off the surface of the article of footwear, so to speak, which further reduces the burden on the underlying (protective) layers.

Because of the special oleophobic and/or hydrophobic treatment, it is also ensured according to the invention that the article of footwear 2 can further show water-repellent properties, so that the article of footwear 2 and thus the footwear unit 1 according to the invention can additionally provide favorable overall protection from rain or moisture.

The substances to be used for the oleophobic or hydrophobic equipment as such or the methods pertaining thereto for equipping the article of footwear 2 are well-known as such to the person skilled in the art. In the context of the present invention, it can be provided for example in this connection that the oleophobic or hydrophobic equipment and/or the oleophobic and/or hydrophobic layer (9*a*) is/are present in the form of an impregnation or coating. In this case, the impregnation or coating can be carried out by means of at least one fluorocarbon or at least one fluorohydrocarbon, in particular a fluorinated polymer. In this respect, for example, derivatives of perfluorinated alkanesulfonic acids can be used. Similarly, polytetrafluoroethylene (PTFE) can also be used. In addition, the use of fluorinated silicones in particular is generally suitable.

According to an alternative embodiment of the present invention, the oleophobic or hydrophobic agent or layer 9*a* can be implemented or applied by means of plasma treatment (cf. FIG. 2).

For this purpose, the plasma treatment can be carried out directly on the surface of the article of footwear 2, in particular on the surface of the outer or covering layer 5 of the article of footwear 2. The plasma treatment can also be carried out indirectly on the surface of the article of footwear 2, in particular on the surface of the outer or covering layer 5 of the article of footwear 2. In this respect, the plasma treatment can be carried out after application of a preferably polymeric or polymerizable film to the surface to be treated, wherein the polymeric or polymerizable film is crosslinked or cured by means of the plasma treatment. In particular, silicones, especially silicone oils, or organopolysiloxanes can be used as a polymeric or polymerizable film. With respect to the plasma treatment that can be used according to the invention, reference can be made to German patent application DE 10356776 A1, filed by the present applicant, and the patent applications from the same patent family WO 2005/053838 A1 and US 2007/0134483 A1, the entire disclosed contents of which are incorporated herein by reference in their entirety.

Moreover, it can also be provided according to the invention that the article of footwear 2 comprises a fire or flame-retardant agent or layer 9*b*. In this respect, the fire or flame-retardant agent or layer 9*b* can be in the form of an impregnation or coating (cf. FIG. 2).

In particular, the fire or flame-retardant agent or layer (9*b*) can be provided on or applied to the side of the article of footwear 2 facing towards the toxic or harmful substances during wear. In this connection, the fire or flame-retardant agent or layer 9*b* can be provided on or applied to the side of the article of footwear 2 facing away from the area of the foot to be protected during wear. Similarly, it can be provided that the fire or flame-retardant agent or layer 9*b* is provided on or applied to the outer or covering layer 5 of the article of footwear 2. In addition, the fire or flame-retardant agent or layer 9*b* can in particular be arranged on the side of the outer or covering layer 5 facing away from the area of the foot to be protected during wear.

In particular, the fire or flame-retardant agent or layer 9*b* can be configured based on (i) phosphoric acid compounds, in particular phosphoric acid esters; (ii) metal salts, in particular antimony or aluminum salts; (iii) fluorinated polymers; and mixtures of two or more of the above-mentioned compounds. As corresponding coating or impregnation methods for equipping the fire or flame-retardant properties in question are well known to the person skilled in the art, no further explanations in this regard are required.

According to a particularly preferred embodiment of the invention, it can be provided that the article of footwear 2, in particular the multilayer structure 2*a* or the laminate 2*a* or the multilayer material 2*a*, contains no adsorptive material or is free of adsorptive materials, in particular free of activated carbon (cf. FIG. 2). Accordingly, it is provided according to this preferred embodiment of the invention that the article of footwear 2 has no or essentially no adsorptive properties. According to the invention, it can thus be the case that the article of footwear 2 as such, in particular in contrast to the inner shoe material 3, comprises no adsorption layer or no adsorptive material as such, in particular no activated carbon. In this manner, one can improve in particular the mechanical stability of the article of footwear 2 exposed to strong mechanical stress during wear. The preferred configuration of the article of footwear 2 without adsorptive material is made possible in particular by the modular structure of the footwear unit 1 according to the invention, according to which specifically the inner shoe material 3, which is subjected to lower mechanical stress, is provided with the adsorptive material 14.

Further with respect to the article of footwear 2 on which the functional footwear unit 1 according to the invention is based, this can, as shown in FIG. 1, comprise a preferably flame-retardant sole 23. The sole 23 can be at least essentially water and/or air-impermeable. In particular, the sole 23 can be composed of a plastic or rubber material.

It can be provided according to the invention that the article of footwear 2 is configured in multiple pieces or parts. In this case, the individual (surface) sections of the article of footwear 2 can be connected to one another by means of sewing, gluing, and/or welding. In particular, the individual (surface) sections of the article of footwear 2 can be connected to one another by means of connecting areas, in particular seams. For example, the connecting areas can be waterproofed or sealed with seam sealing strips or the like. As mentioned above, the article of footwear 2 can be in the form of numerous embodiments. In particular, the article of footwear 2 can be in the form of a combat boot, firefighting boot, work boot, protective boot, lace-up boot or the like.

In the following, the inner shoe material 3 on which the functional footwear unit 1 according to the invention is based will be described in further detail:

It can be provided in particular according to the invention that the inner shoe material 3 has a multilayer, in particular laminate-type structure 3*a*. In particular, the inner shoe material 3 can be configured in multiple layers, in particular in the form of a laminate 3*a*. In addition, the inner shoe material 3 can in particular comprise or be composed of a multilayer material 3*a*. By means of selective selection and coordination of the respective layers, the properties of the inner shoe material can be adjusted and in particular coordinated with respect to the article of footwear 2.

In this connection, it can be provided in particular according to the invention that the individual layers 10, 11, 12, 16, 17 of the multilayer structure 3*a* or the laminate 3*a* or the multilayer material 3*a* are connected to one another in particular sectionally or in particular over their entire surface. In particular, the individual layers 10, 11, 12, 16, 17 of the multilayer structure 3*a* or the laminate 3*a* or the multilayer material 3*a* can form a composite.

According to the invention, it is advantageous if the inner shoe material 3, in particular the multilayer structure 3*a* or the laminate 3*a* or the multilayer material 3*a*, is configured to be air-permeable and/or water or water vapor-permeable. By means of the preferably provided air permeability and water or water vapor permeability of the inner shoe material 3, the wearing comfort of the footwear unit 1 according to the invention is improved overall, particularly because sweat can be more effectively removed. Moreover, effective purification of the air flow passing through the inner shoe material 3 is ensured by improved incident flow or throughflow properties of the adsorptive material 14 or the adsorption layer 12 of the inner shoe material 3.

In this connection, it can be provided according to the invention that the inner shoe material 3, in particular the multilayer structure 3*a* or the laminate 3*a* or the multilayer material 3*a*, has an air permeability measured according to DIN 53887 or measured at a flow resistance of 127 Pa of at least 200 $l/m^2$ per second, preferably at least 300 $l/m^2$ per second, preferably at least 400 $l/m^2$ per second, particularly preferably at least 600 $l/m^2$ per second, and most particularly preferably at least 800 $l/m^2$ per second.

According to a further, but less preferable embodiment, it can also be provided according to the invention that the inner shoe material 3, in particular the multilayer structure 3*a* or the laminate 3*a* or the multilayer material 3*a*, is configured to be water-impermeable or air-impermeable, but water vapor-permeable. In particular, it can be provided according to this less preferable embodiment of the invention that the inner shoe material 3, in particular the multilayer structure 3*a* or the laminate 3*a* or the multilayer material 3*a*, is configured to be breathable. This is in particular the case when the inner shoe material 3, as discussed in the following, has a membrane 17 or a barrier layer as a further layer according to this less favorable embodiment of the invention.

The wearing comfort of the inner shoe material 3 and thus the footwear unit 1 according to the invention as a whole can be further improved in that according to an embodiment of the invention, the inner shoe material 3, in particular the multilayer structure 3*a* or the laminate 3*a* or the multilayer material 3*a*, is configured to be extensible or elastic (in particular reversibly extensible) in at least one direction to at least 10%, preferably to at least 20%, based on the length or width of the inner shoe material in an unstretched state. In this manner, the adaptation of the inner shoe material 3 to the anatomy of the wearer can be improved, which also leads to a snug and wrinkle-free fit of the inner shoe material 3 in the area of the foot, thus reducing the formation of pressure or abrasion points or blisters by the wearer of the footwear unit 1.

With respect to the structure of the inner shoe material 3, said inner shoe material 3, in particular the multilayer structure 3*a* or the laminate 3*a* or the multilayer material 3*a*, can comprise at least one inner layer or a carrier material 10 (cf. FIG. 3A through 3D). In this case, the inner layer or the carrier material 10 can be provided on the inside of the inner shoe material, in particular during wear or use. In particular, the inner layer or the carrier material 10 can be provided on the side of the inner shoe material 3 facing towards the foot area to be protected during wear. In other words, it is the case in the context of the present invention in particular that the inner layer or the carrier material 10 lies against the skin of a wearer during wear or use, in particular in the foot area or in the area of the ankle joint or the adjacent lower leg.

The inner layer or the carrier material 10 can preferably be a textile sheet material, preferably an air-permeable textile material, in particular a woven fabric, knit fabric, crocheted fabric, laid fabric, web or nonwoven or textile composite. In particular, the inner layer or the carrier material 10 can have a weight per unit area in the range of 10 $g/m^2$ to 400 $g/m^2$, in particular in the range of 20 $g/m^2$ to 200 $g/m^2$, and preferably in the range of 30 $g/m^2$ to 150 $g/m^2$.

According to a further embodiment of the invention, the inner shoe material 3, in particular the multilayer structure 3*a* or the laminate 3*a* or the multilayer material 3*a*, can comprise at least one outer layer 11 (cf. FIGS. 3A through 3D). Concerning the outer layer 11, said layer can be provided, in particular during wear or use, on the outer side of the inner shoe material 3. In particular, the outer layer 11 can be provided on the side of the inner shoe material facing away from the foot area to be protected during wear 3. In other words, it is the case in the context of the present invention in particular that the outer layer 11 of the inner shoe material 3 lies loosely or in an unconnected manner against the article of footwear 2, in particular the inner layer 6 of the article of footwear 2, during wear or use of the functional footwear unit 1.

Further concerning the outer layer 11 of the inner shoe material 3, it is advantageous if said outer layer 11 is a textile sheet material, preferably an air-permeable textile material. In this manner, wearing comfort can also be further improved with respect to air permeability and removal of sweat. In this connection, the outer layer 11 can be a woven fabric, knit fabric, crocheted fabric, laid fabric, web or nonwoven or a textile composite, in particular a woven fabric or knit fabric. In the context of the present invention, it has been found to be advantageous if the outer layer 11 has a weight per unit area in the range of 5 $g/m^2$ to 350 $g/m^2$, in particular in the range of 10 $g/m^2$ to 300 $g/m^2$, and preferably in the range of 20 $g/m^2$ to 100 $g/m^2$.

With respect to the inner layer or the carrier material 10 on the one hand or the outer layer 11 on the other, the materials specifically used for this purpose can be configured as defined below.

In particular, it can be provided in the context of the present invention that the inner layer or the carrier material 10 or the outer layer 11, independently of one another, is/are a textile sheet material composed of natural or synthetic fibers, preferably synthetic fibers (chemical fibers). In addition, it can be provided according to the invention that the inner layer or the carrier material 10 or the outer layer 11, independently of one another, is/are a textile sheet material containing or composed of natural or synthetic fibers, in particular from the group of polyesters (PES); polyolefins, such as polyethylene (PE) and polypropylene (PP), polyvinylchloride (CLF); polyvinylidenechloride (CLF); acetate (CA); triacetate (CTA); polyacrylic (PAN), polyamide (PA); polyaramids; polyvinyl alcohol (PVAL); polyurethanes; polyvinyl esters; (meth)acrylates; and mixtures and combinations thereof.

According to the invention, the inner shoe material 3, in particular the multilayer structure 3*a* or the laminate 3*a* or the multilayer material 3*a*, can comprise at least one adsorption layer 12 comprising or composed of the adsorptive material 14, as shown in FIGS. 3A through 3D. In this connection, the adsorption layer 12 can be arranged in particular between the inner layer or the carrier material 10 and the outer layer 11. According to the invention, it is advantageous if the adsorption layer 12 is configured to be discontinuous. In particular, the adsorption layer 12 can be configured as an adsorption sheet filter.

By means of the presence of the adsorptive material 14 or an adsorption layer 12, it is ensured in the context of the present invention that any toxic or harmful substances, in particular chemical toxins or warfare agents penetrating through the outer layer of the article of footwear 2 or through the article of footwear 2 as such, do not come into contact with the foot, as the toxic or harmful substances in question are taken up or adsorbed by the adsorptive material 14 of the adsorption layer 12 and thus rendered harmless by the inner shoe material 3. In this manner, according to the invention, efficient protection against the harmful substances in question with simultaneous high wearing comfort of the functional footwear unit according to the invention 1 is ensured.

In the context of the present invention, a number of different adsorptive materials 14 can be used as such or for the adsorption layer 12:

In the context of the present invention, however, it is preferred if the adsorptive material 14, in particular the adsorptive material 14 of the adsorption layer 12, is selected from the group of (i) particulate activated carbon and/or activated carbon particles in particular, preferably in the form of activated carbon particles in granular form ("granular carbon") or in spherical form ("spherical carbon"); (ii) zeolites, in particular natural and/or synthetic zeolites; (iii) molecular sieves, in particular zeolite molecular sieves, synthetic molecular sieves and/or in particular synthetic molecular sieves based on carbon, oxides and/or glasses; (iv) metal oxide and/or metal particles; (v) ion-exchange resins, in particular polydisperse and/or monodisperse cation and/or anion exchangers, in particular of the gel type and/or macroporous type; (vi) anorganic oxides, in particular silicon dioxides, silica gels and/or aluminum oxides; (vii) porous organic polymers and/or porous organic-anorganic hybrid polymers and/or organometallic framework materials, in particular MOFs (metal organic frameworks), COFs (covalent organic frameworks), ZIFs (zeolite imidazolate frameworks), POMs (polymer organic materials) and/or OFCs; (viii) mineral granulates; (ix) clathrates; and (x) mixtures and/or combinations thereof.

According to a particularly preferred embodiment, the adsorptive material 14, in particular the adsorptive material 14 of the adsorption layer 12, can be formed from or composed of preferably particulate activated carbon or activated carbon particles, preferably in the form of activated carbon particles in granular form ("granular carbon") or in spherical form ("spherical carbon").

In general, the adsorptive materials 14 used can be present in the form of discrete particles or in particulate form (cf. FIGS. 3A through 3D).

The respective grain or particle-forming materials of the adsorptive materials 14 used according to the invention are well-known per se to the person skilled in the art, and the person skilled in the art is capable at any time of selecting and coordinating the respective adsorptive material 14 in order to impart special properties, in particular adsorption properties, to the inner shoe material 3 or the functional footwear unit 1 according to the invention.

Reference can be made to the following explanations with respect to activated carbons that can be used according to the invention. Moreover, for further details on the MOF materials than can be used in the same manner according to the invention, reference can be made in particular to the international patent application WO 2009/096184 A1 and the parallel German patent application DE 10 2008005218 A1, the respective disclosures of which are incorporated herein by reference in their entirety.

As mentioned above, the adsorptive material 14, in particular the adsorptive material 14 of the adsorption layer 12, can be configured in grain or particle form.

With respect to the diameter or mean diameter $D_{50}$ of the adsorptive materials 14 used according to the invention, said diameter of the adsorptive material 14, in particular the preferably particulate activated carbon or the activated carbon particles, should be in the range of 0.005 mm to 2.5 mm, preferably in the range of 0.01 mm to 2 mm, preferably in the range of 0.015 mm to 0.5 mm, particularly preferably in the range of 0.02 mm to 0.3 mm, and most particularly preferably in the range of 0.03 mm to 0.15 mm. In this connection, the mean diameter, in particular the mean diameter $D_{50}$, of the adsorptive material 14, in particular the preferably particulate activated carbon and/or the activated carbon particles, should be in the range of 0.01 mm to 2 mm, in particular in the range of 0.02 mm to 1 mm, preferably in the range of 0.03 mm to 0.5 mm, particularly preferably in the range of 0.04 mm to 0.4 mm, and most particularly preferably in the range of 0.04 mm to 0.2 mm.

The corresponding particle sizes can be determined in particular based on the method according to ASTM D2862-97/04. In addition, the above-mentioned values can be determined by determination methods based on sieve analysis, x-ray diffraction, laser diffractometry, or the like. The respective determination methods are well-known per se to the person skilled in the art, so that no further explanations in this connection are required.

In general, the adsorptive material 14, in particular the preferably particulate activated carbon or the activated carbon particles, can be used in an amount in the range of 5 $g/m^2$ to 200 $g/m^2$, in particular 10 $g/m^2$ to 150 $g/m^2$, preferably 15 $g/m^2$ to 100 $g/m^2$, and preferably 20 $g/m^2$ to 75 $g/m^2$, or can be present in the corresponding amounts in the adsorption layer 12 or inner shoe material 3. In this connection, the footwear unit 1 as such or the inner shoe material 3, in particular the adsorption layer 12 of the inner shoe material 3, can contain the adsorptive material 14, in particular the preferably particulate activated carbon or the activated carbon particles, in an amount in the range of 5 $g/m^2$ to 200 $g/m^2$, in particular 10 $g/m^2$ to 150 $g/m^2$, preferably 15 $g/m^2$ to 100 $g/m^2$, and preferably 20 $g/m^2$ to 75 $g/m^2$.

With respect to the activated carbon or activated carbon particles as such used or applied in the context of the present invention (referred to here only as activated carbon), the parameters indicated with respect to the underlying activated carbon or activated carbon particles are determined by standardized or explicitly stated determination methods or by determination methods known per se to the person skilled in the art. In particular, the parameters indicated with respect to characterization of porosity, pore size distribution, and other adsorption properties are generally based on the respective nitrogen sorption isotherms of the activated carbon or measured products in question. In addition, pore distribution, in particular with respect to the content of micropores based on total pore volume, can also be determined based on DIN 66135-1.

According to a preferred embodiment of the invention, according to which the adsorptive material 14 is used in the form of activated carbon or activated carbon particles, the activated carbon can be obtainable by carbonization and subsequent activation of a starting material that is synthetic or not based on natural substances, in particular based on organic polymers. In this connection, the preferably particulate activated carbon can be obtained from a starting material based on organic polymers, in particular based on sulfonated organic polymers, preferably based on divinylbenzene cross-linked polystyrene, and preferably based on styrene/divinylbenzene copolymers, in particular by carbonization and subsequent activation of the starting material. In this respect, the content of divinylbenzene in the starting material can be in the range of 1 wt % to 20 wt %, in particular 1 wt % to 15 wt %, preferably 1.5 wt % to 12.5 wt %, and preferably 2 wt % to 10 wt % based on the starting material. According to the invention, the starting material can in particular be an ion-exchange resin containing sulfonated or sulfonic acid groups, in particular of the gel type.

According to a preferred embodiment of the invention, a polymer-based spherical activated carbon PBSAC) can be used as the preferably particulate activated carbon. In particular, the activated carbon can be a polymer-based spherical activated carbon (PBSAC). Such activated carbons are characterized by outstanding adsorption properties with respect to the aforementioned toxic or harmful substances and outstanding mechanical properties, such as high material hardness and abrasion hardness.

In principle, the activated carbon used can in this case be obtained by known methods of the prior art: In particular, for this purpose, spherical sulfonated organic polymers, in particular based on divinylbenzene cross-linked polystyrene, can be carbonized and then activated to obtain the relevant activated carbon, in particular as mentioned above. For further details in this connection, reference can be made for example to the documents DE 4328219 A1, DE 4304026 A1, DE 19600237 A1 and EP 1918022 A1 or to the parallel document U.S. Pat. No. 7,737,038 B2, which belongs to the same patent family, the respective contents of which are incorporated herein by reference in their entirety.

In the context of the present invention, the activated carbons or activated carbon particles used are generally commercially obtainable or in common commercial use. In particular, activated carbons that are distributed for example by Blücher GmbH, Erkrath, Germany, or AdsorTech GmbH, Premnitz, Germany can be used.

In the context of the present invention, it has been found to be advantageous if the preferably particulate activated carbon used according to the invention has a further specified total pore volume, in particular a total pore volume according to Gurvich, as discussed below. In particular, the preferably particulate activated carbon can have a total pore volume, in particular a total pore volume according to Gurvich, in the range of 0.3 $cm^3/g$ to 3.8 $cm^3/g$, in particular in the range of 0.4 $cm^3/g$ to 3.5 $cm^3/g$, preferably in the range of 0.5 $cm^3/g$ to 3 $cm^3/g$, particularly preferably in the range of 0.6 $cm^3/g$ to 2.5 $cm^3/g$, and most particularly preferably in the range of 0.5 $cm^3/g$ to 1.5 $cm^3/g$.

In particular, at least 65%, in particular at least 70%, preferably at least 75%, preferably at least 80%, of the total pore volume, in particular the total pore volume according to Gurvich, of the preferably particulate activated carbon can be composed of pore diameters of at most 50 nm, in particular micro- and/or mesopores.

In particular, 50% to 95%, in particular 60% to 90%, preferably 70% to 85%, of the total pore volume, in particular the total pore volume according to Gurvich, of the preferably particulate activated carbon can be composed of pores with diameters of at most 50 nm, in particular micro- and/or mesopores.

In addition, 1% to 60%, in particular 5% to 50%, preferably 10% to 40%, preferably 15% to 35%, of the total pore volume, in particular the total pore volume according to Gurvich, of the preferably particulate activated carbon can be made up by pores with diameters of more than 2 nm, in particular meso- and/or macropores.

In particular, the preferably particulate activated carbon can have a pore volume composed of pores with diameters of at most 2 nm (i.e. ≤2 nm), in particular micropore volumes according to carbon black in the range of 0.05 $cm^3/g$ to 2.5 $cm^3/g$, in particular 0.15 $cm^3/g$ to 2 $cm^3/g$, preferably 0.3 $cm^3/g$ to 1.5 $cm^3/g$. In this connection, 15% to 98%, in particular 25% to 95%, and preferably 35% to 90% of the total pore volume of the activated carbon can be composed of pores with diameters of at most 2 nm, in particular micropores.

The determination of total pore volume according to Gurvich is a measurement/determination method well known per se to the person skilled in the art in this field. For further details with respect to the determination of the total pore volume according to Gurvich, reference can be made for example to L. Gurvich (1915), J. Phys. Chem. Soc. Russ. 47, 805, and S. Lowell et al., Characterization of Porous Solids and Powders: Surface Area Pore Size and Density, Kluwer Academic Publishers, Article Technology Series, pages 111 ff. In particular, the pore volume of the activated carbon based on the Gurvich rule can be determined according to the formula $V_P=W_a/\rho l$, wherein Wa denotes the adsorbed amount of an underlying adsorbate and ρl denotes the density of the adsorbate used (cf. also Formula (8.20) according to page 111, chapter 8.4. of S. Lowell et al.).

The determination method according to carbon black is known per se to the person skilled in the art, wherein reference can additionally be made for further details on determination of pore surface area and pore volume according to carbon black for example to R. W. Magee, Evaluation of the External Surface Area of Carbon Black by Nitrogen Adsorption, presented at the Meeting of the Rubber Division of the American Chem. Soc., October 1994, reported e.g. in: Quantachrome Instruments, AUTOSORB-1, AS1 WinVersion 1.50, Operating Manual, OM, 05061, Quantachrome Instruments 2004, Florida, USA, pp. 71 ff. In particular, the evaluation in this respect can be carried out by means of the t plot method.

As determination of specific surface area according to BET is generally known per se to the person skilled in the art, no further details thereon need to be presented. All indicated BET surface area values relate to determination according to ASTM D6556-04. In the context of the present invention—in general and in the absence of specific indications to the contrary—the so-called multi-point BET determination method (MP-BET) is used for determination of BET surface area in a partial pressure range $p/p_0$ of 0.05 to 0.1.

For further details on determination of the BET surface or the BET method, reference can be made to the above-mentioned ASTM D6556-04 and to Römpp's Chemistry Lexicon, $10^{th}$ Edition, Georg Thieme Publishing House, Stuttgart/New York, key word: "BET method", including the literature cited therein, and to Winnacker-Küchler ($3^{rd}$ Edition), Vol. 7, pp. 93 ff. and Z. Anal. Chem. 238, pp. 187 through 193 (1968).

In the context of the present invention, the term "micropores" refers to pores with diameters of less than 2 nm, while the term "mesopores" refers to pores with diameters in the range of 2 nm (i.e. 2 nm inclusively) to 50 nm inclusively, and the term "macropores" refers to pores with diameters of more than 50 nm (i.e. >50 nm).

Moreover, the preferably particulate activated carbon can have a specific BET surface area in the range of 600 $m^2/g$ to 4,000 $m^2/g$, in particular 800 $m^2/g$ to 3,500 $m^2/g$, preferably 1,000 $m^2/g$ to 3,000 $m^2/g$, particularly preferably 1,200 $m^2/g$ to 2,750 $m^2/g$, and most particularly preferably 1,300 $m^2/g$ to 2,500 $m^2/g$.

In particular, the preferably particulate activated carbon can have a surface area composed of pores with diameters of at most 2 nm, in particular micropores, in the range of 400 to 3,500 $m^2/g$, in particular 500 to 3,000 $m^2/g$, preferably 600 to 2,500 $m^2/g$, and preferably 700 to 2,000 $m^2/g$.

The preferably particulate activated carbon that is usable according to the invention can have a surface area comprising pores with diameters in the range of 2 nm to 50 nm, in particular mesopores, in the range of 200 to 2,000 $m^2/g$, in particular 300 to 1,900 $m^2/g$, preferably 400 to 1.800 $m^2/g$, and preferably 500 to 1,700 $m^2/g$. In addition, the preferably particulate activated carbon, as it can be used in the context of the present invention, can have a mean pore diameter in the range of 0.1 nm to 55 nm, in particular 0.2 nm to 50 nm, preferably 0.5 nm to 45 nm, and preferably 1 nm to 40 nm.

In the context of the present invention, it can also be provided that the adsorptive material 14, in particular the preferably particulate activated carbon, is impregnated with at least one catalyst. For this purpose, copper, silver, cadmium, platinum, palladium, zinc and/or mercury ions can preferably be used as catalytic enzymes and/or metal ions. The amount of the catalyst can be 0.05 to 12 wt %, preferably 1 to 10 wt %, and particularly preferably 2 to 8 wt % based on the weight of the adsorptive material 14, in particular the preferably particulate activated carbon. By equipping the adsorptive material 14 with a catalyst, autoregeneration of the adsorptive material 14 can be improved, which results in prolonged useful life or to later depletion of the adsorptive material 14 during wear or use.

According to the invention, it can additionally be provided that, as shown in FIGS. 3A through 3D, the adsorption layer 12 comprises at least one carrier 13. In this case, the carrier 13 can be arranged on the side of the adsorption layer 12 facing the inner layer 10. In particular, the carrier 13 can be arranged between the inner layer 10 and the adsorptive material 14. The carrier 13 in particular is a textile sheet material, preferably an air-permeable textile material, in particular a woven fabric, knit fabric, crocheted fabric, laid fabric, web or nonwoven or textile composite, preferably a woven fabric. In this connection, the carrier 13 can have a weight per unit area in the range of 5 $g/m^2$ to 250 $g/m^2$, in particular in the range of 10 $g/m^2$ to 200 $g/m^2$, and preferably in the range of 15 $g/m^2$ to 100 $g/m^2$. The carrier 13 can serve in particular for fastening or fixation of the adsorptive material 14, as explained in the following. In this manner, the stability of the inner shoe material 3 can be further increased. In addition, wearing comfort is increased, as the additional carrier 13 also takes on the properties of a lining material. In this connection, the use of an additional carrier 13 is advantageous, for example in the use of a particulate adsorptive material with a relatively large particle diameter. In general, however, the adsorptive material 14 can also be fixed in place on the inner layer or the carrier material 10, in particular if a carrier 13 is provided.

As mentioned above, it can be provided according to the invention that the adsorptive material 14, in particular the preferably particulate activated carbon, is fastened on the inner layer or the carrier material 10 or on the carrier 13. In this connection, the adsorptive material 14 should be arranged on the side of the inner layer facing the outer layer 11 or on the carrier material 10 or the carrier 13. In the context of the present invention, it can also be provided in principle that both sides of the inner layer or the carrier material 10 or the carrier 13 are equipped with the adsorptive material 14, even though this is less preferable.

As shown in FIGS. 3A through 3D, it can be provided in the context of the present invention that fastening or fixation of the adsorptive material 14, in particular the preferably particulate activated carbon, is carried out by means of at least one adhesive layer 15*a*, 15*b*. In this connection, the adsorption layer 12 can comprise at least one adhesive layer 15*a*, 15*b* for fastening or fixation of the adsorptive material 14. In this connection, it is preferred according to the invention if the adhesive layer 15*a*, 15*b* is arranged between the adsorptive material 14 and the inner layer or the carrier material 10 or the carrier 13. The adhesive layer 15*a*, 15*b* is generally an adhesive layer used for fixation of the in particular particulate adsorptive material 14 onto the corresponding layers 10, 13.

The adhesive layer in question 15*a*, 15*b* can in particular be a discontinuously and/or air-permeably configured adhesive layer. Because of the air permeability of the adhesive layer 15*a*, 15*b* as well, wearing comfort is further improved. In addition, the adsorptive material used according to the invention 14 is optimally accessible by the toxic or harmful substances to be adsorbed.

Figure 3A:
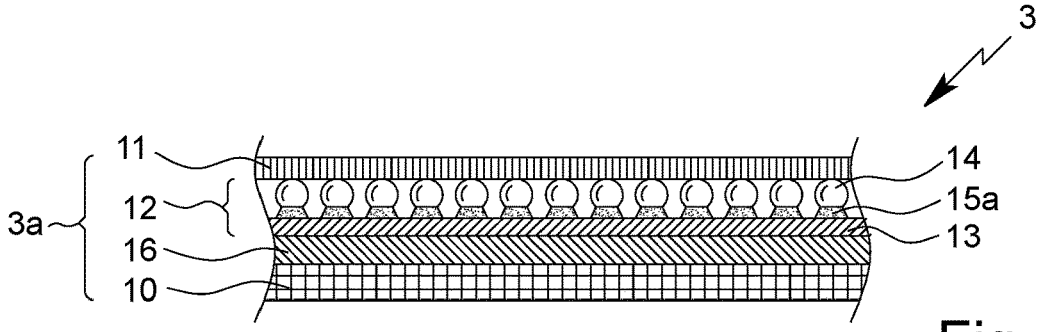
FIG. 3A provides a diagrammatic sectional view in the form of a sectional enlargement of FIG. 1 (section II of said figure) through the layer structure of an inner shoe material on which the footwear unit according to the invention is based, with discontinuous fixation of the adsorptive material used for the inner shoe material, wherein the layer structure comprises no additional membrane (preferred embodiment compared to FIG. 3C)
Figure 3B:
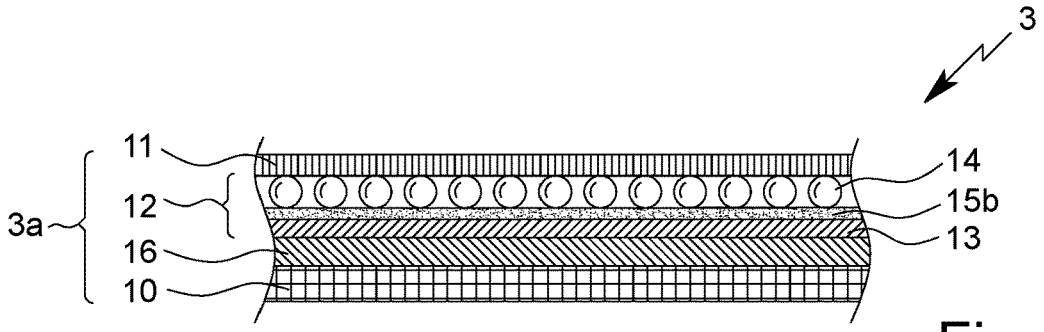
FIG. 3B provides a further diagrammatic sectional view in the form of a sectional enlargement of FIG. 1 (section II) through the layer structure of the inner shoe material according to an alternative embodiment of the present invention, according to which the adsorptive material is fastened in place by means of a continuously configured fixation, for example in the form of a foam or the like, wherein the layer structure comprises no additional membrane (preferred embodiment compared to FIG. 3D)
Figure 3C:
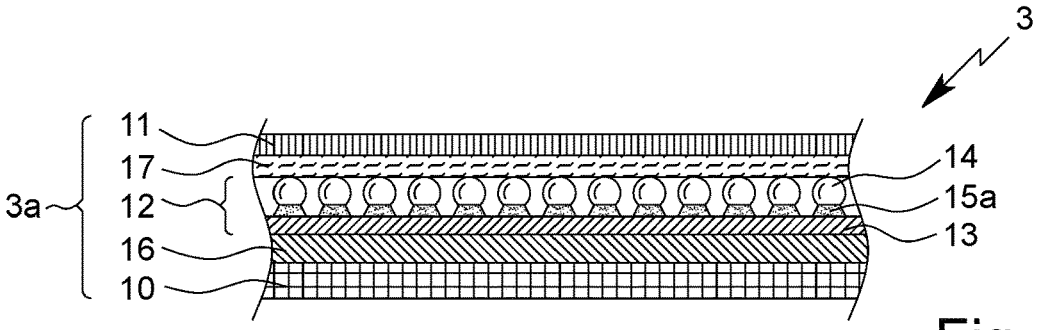
FIG. 3C provides a diagrammatic sectional view in the form of a sectional enlargement of FIG. 1 (section II of said figure) through the layer structure of an inner shoe material on which the footwear unit according to the invention is based, with discontinuous fixation of the adsorptive material used, wherein the layer structure comprises an additional membrane (less preferable embodiment compared to FIG. 3A)

In this connection, the adhesive layer 15*a*, 15*b* can be configured in the form of an adhesive layer 15*a* that in particular is configured to be air-permeable and/or discontinuous and/or punctate or non-coherent or in the form of an adhesive layer 15*a* having discrete adhesive clumps, as illustrated in FIGS. 3A and 3C. In this connection, the adhesive clumps can preferably be applied to the corresponding layer 10, 13 in the form of a regular pattern or grid. Because of the discontinuous or punctate and non-cohesive application of the adhesive layer 15*a*, air permeability is high overall, and at the same time, the layer material as a whole is highly flexible.

In this connection, it is preferred according to the invention that at least 50%, in particular at least 60%, preferably at least 70%, particularly preferably at least 75%, and most particularly preferably at least 80% of the carrier material 10 or the carrier 13, based on the total area of the inner layer or the carrier material 10 or the carrier 13, is impinged upon by the adhesive or adhesive agent constituting the adhesive layer 15*a*, 15*b* or by the adsorptive material 14, based on the total area of the inner layer or the carrier material 10 or the carrier 13.

In the context of the present invention, it can also be provided that the adhesive layer 15*a*, 15*b* is configured in the form of an in particular air-permeable, flat and/or continuously and/or coherently configured adhesive layer 15*b*. In this connection, reference can be made in particular to the views shown in FIG. 3B and FIG. 3D. In particular, the adhesive layer 15*b* can be configured in the form of an in particular air-permeable foam material.

Further with respect to the adhesive layer, said layer can in particular be an air-permeably configured adhesive layer 15*b* based on a dried or cured, in particular cross-linked, broken adhesive polymer foam. For this purpose, the broken adhesive polymer foam can comprise a number of dried or cured, in particular cross-linked, destroyed or burst and/or collapsed foam bubbles. In addition, the broken adhesive polymer foam, in particular the dried or cured, in particular cross-linked, destroyed or burst and/or collapsed foam bubbles of the broken adhesive foam, can comprise numerous destroyed or broken or collapsed walls or projections composed of an adhesive polymer. As a result of the configuration of the adhesive layer 15*b* in the form of the above-mentioned foam material, a corresponding air permeability is ensured, with simultaneously higher accessibility of the adsorptive material 14. The provision of the adhesive layer 15*b* based on the above-mentioned foam system also results in improved overall wearing comfort of the inner shoe material 3 and thus the footwear unit 1 according to the invention.

In order to produce the above-described adhesive layer 15*b* in the form of a broken foam, the method can be used for example of applying a foamed solution or dispersion of the underlying adhesive polymer to the corresponding carrier 10, 13, after which the adsorptive material 14 in particular is applied or caused to adhere, in the form of the particulate activated carbon, to the adhesive or adhesive agent layer 15*b*, followed by drying or curing of the adhesive polymer, accompanied by breaking of the foam produced from the foamed solution or dispersion, so that the adhesive layer 15*b* is obtained or present as a dried or cured, in particular cross-linked, broken adhesive polymer foam.

Also with respect to the adhesive layer 15*a*, 15*b*, this can be applied to the inner layer or the carrier material 10 or the carrier 13 in an amount in the range of 5 $g/m^2$ to 100 $g/m^2$, in particular in the range of 10 $g/m^2$ to 80 $g/m^2$, and preferably in the range of 20 $g/m^2$ to 60 $g/m^2$. In particular, the adhesive layer 15*a*, 15*b* can have a weight per unit area in the range of 5 $g/m^2$ to 100 $g/m^2$, in particular in the range of 10 $g/m^2$ to 80 $g/m^2$, and preferably in the range of 20 $g/m^2$ to 60 $g/m^2$.

In the context of the present invention, a number of adhesive agents or adhesives are suitable for configuring the adhesive layer in question 15*a*, 15*b*:

For configuration of the adhesive layer 15*a*, 15*b* in the form of a non-coherently configured adhesive layer 15*a* in particular based on application in the form of discrete adhesive clumps, particularly suitable materials are thickened plastic dispersions, hot-melt adhesives, or reactive substances, wherein in particular these can be polyurethane-based one or two-component systems, preferably prepolymeric diisocyanates, which in particular undergo crosslinking via di- or polyfunctional amines or alcohols.

With respect to the embodiment according to which the adhesive layer 15*a*, 15*b* is configured in the form of a continuously or coherently configured adhesive layer 15*b*, in particular in the form of an air-permeable foam material, corresponding adhesive agents or adhesives that are generally suitable for the adhesive layer 15*b* or for the adhesive polymer include adhesive agents or adhesives selected from the group of polyacrylate (PA), polymethacrylate (PMA), polymethyl methacrylate (PMMA), polycarbonate (PC), polyurethane (PU) and silicones and mixtures or combinations of at least two of the above-mentioned compounds, preferably polyurethane (PU). In particular, the adhesive agent or adhesive for the adhesive layer 15*a*, 15*b*, in particular the adhesive polymer, can be a polyurethane (PU).

According to the invention, it can also be provided that the inner shoe material 3, in particular the multilayer structure 3*a* or the laminate 3*a* or the multilayer material 3*a*, comprises a spacing layer 16 (cf. FIG. 3A through 3D). In particular, the first spacing layer 16 can be arranged between the inner layer or the carrier material 10 and the adsorption layer 12. In particular, the spacing layer 16 can be arranged between the inner layer or the carrier material 10 and the optionally present carrier 13 of the adsorption layer 12. In this case, the spacing layer 16 can be configured as a web (nonwoven), an in particular air-permeable foam layer or a textile sheet material, in particular a woven fabric or knit fabric, and preferably a knit fabric. In particular, the spacing layer 16 can have a weight per unit area in the range of 5 $g/m^2$ to 150 $g/m^2$, in particular 10 $g/m^2$ to 125 $g/m^2$, preferably 15 $g/m^2$ to 100 $g/m^2$, and preferably 20 $g/m^2$ to 75 $g/m^2$. In particular, the spacing layer 16 can absorb or attenuate mechanical stresses and thus protect or stabilize the adsorption layer 12. In addition, the additional spacing layer 16 makes it possible to further improve wearing comfort, in particular wearing feel.

According to a preferred embodiment of the invention, it is also provided in the context of the present invention that the inner shoe material 3, in particular the multilayer structure 3*a* or the laminate 3*a* or the multilayer material 3*a*, comprises no in particular air-impermeable (barrier) layers or no in particular air-impermeable membrane, in particular no membrane impermeable to chemical or biological or nuclear toxic or harmful substances, in particular warfare agents, as shown in FIGS. 3A and 3B. In this manner, the air permeability of the inner shoe material 3 in particular is ensured, which is conducive to wearing comfort. In particular, it is also possible to dispense with equipping the inner shoe material 3 with a membrane against the backdrop of the design according to the invention, according to which the article of footwear 2 as such can already be equipped with a membrane or as such already provides a protective function, as mentioned above.

In the context of the present invention, however, it possible in principle, even though this is less preferable, to equip the inner shoe material 3 with a corresponding membrane, in particular if particularly strong protection against the toxins or harmful substances in question is to be provided.

Figure 3D:
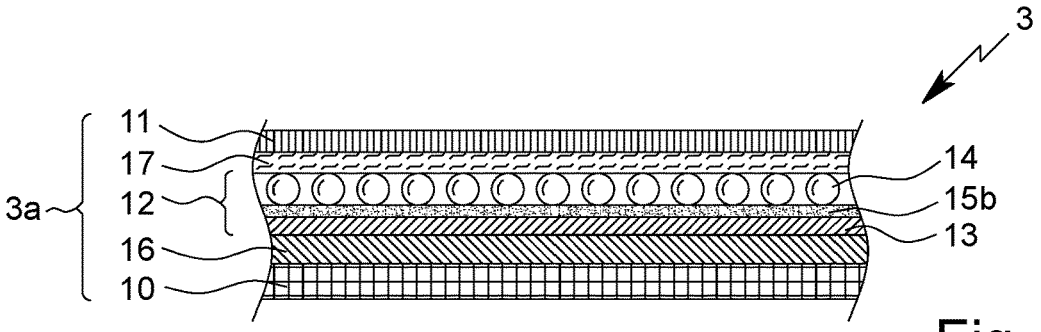
FIG. 3D provides a further diagrammatic sectional view in the form of a sectional enlargement of FIG. 1 (section II) through the layer structure of the inner shoe material according to an alternative embodiment of the present invention, according to which the adsorptive material is fastened in place by means of a continuously configured attachment, for example in the form of a foam or the like, wherein the layer structure has an additional membrane (less preferable embodiment compared to FIG. 3B)

It can thus be provided in the context of the present invention that the inner shoe material 3, in particular the multilayer structure 3*a* or the laminate 3*a* or the multilayer material 3*a*, comprises at least one membrane 17, as shown in FIGS. 3C and 3D. In this connection, the membrane 17 can be arranged for example between the adsorption layer 12 and the outer layer 11, as also shown in FIGS. 3C and 3D. In this manner, the burden on the adsorption layer 12 or the adsorptive material 14 can be relieved. In general, the membrane 17 can be arranged between the inner layer or the carrier material 10 and the outer layer 11.

In this case, the membrane 17 can be configured to be water-impermeable and/or air-impermeable. In particular, the membrane 17 can be configured to be breathable, in particular water vapor-permeable. In addition, the membrane 17 can be at least essentially impermeable to chemical or biological or nuclear toxic or harmful substances, in particular warfare agents. Similarly, the membrane 17 can be a continuous, in particular closed or possibly microporous membrane 17. In addition, the thickness of the membrane 17 can be in the range of 1 to 500 μm, in particular 1 to 250 μm, preferably 1 μm to 100 μm, preferably 1.5 μm to 50 μm, particularly preferably 2.5 μm to 30 μm, and most particularly preferably 5 μm to 25 μm.

In particular, the membrane 17 can have a swellability or a water absorption capacity of at most 35%, in particular at most 25%, based on the net weight of the membrane 17. In addition, the membrane 17 should comprise no or essentially no strongly hydrophilic groups, in particular no hydroxyl groups. Moreover, the membrane 17 should comprise weakly hydrophilic groups, in particular polyether groups. Moreover, the membrane 17 should be configured to be extensible or stretchable in at least one direction, in particular in the longitudinal direction and/or width direction, to at least 10%, in particular to at least 20%, and preferably to at least 30% based on the length and/or width of the membrane 17 in the unstretched and/or non-stretched state.

Further with respect to the membrane 17 of the shoe material, said membrane can comprise or be composed of a plastic or a polymer. In this connection, the plastic or the polymer can be selected from the group of polyurethanes, polyether amides, polyester amides, polyether esters, polytetrafluoroethylenes and/or cellulose-based polymers and derivatives of the above-mentioned compounds, preferably polyether esters and polytetrafluoroethylenes. Moreover, the membrane 17 can be applied, in particular laminated or layered onto, a membrane carrier layer (not shown). In this case, the membrane carrier layer in particular can be an air-permeable two-dimensional textile sheet material, in particular selected from the group of woven fabrics, knit fabrics, crocheted fabrics, laid fabrics, textile composites and non-woven fabrics.

The membrane 17 can have a water vapor permeability at 25° C. and a thickness of 50 μm of at least 12.5 $l/m^2$ per 24 h, in particular at least 17.5 $l/m^2$ per 24 h, and preferably at least 20 $l/m^2$ per 24 h or even more. In addition, the membrane 17 can have a water vapor transmission resistance $R_{et}$ under stationary conditions, measured according to DIN 31 093:1993 of February 1994 or according to international standard ISO 11 092 and at 35° C., of at most 25 $(m^2 \cdot Pa)/W$, in particular at most 20 $(m^2 \cdot Pa)/W$, and preferably at most 13 $(m^2 \cdot Pa)/W$, with a thickness of 50 μm.

For further explanations on the membrane 17 provided for the inner shoe material 3 according to this less preferable embodiment of the present invention, reference can be made to the above explanations of the membrane 7 as it can be used for the article of footwear 2.

Further with respect to the footwear unit 1 according to the invention, the inner shoe material 3 can be configured in multiple pieces or parts. In other words, a plurality of (surface) sections in particular of the above-described multilayer structure 3*a* or laminate 3*a* can be used for the inner shoe material 3, said sections being connected to one another for configuration of the inner shoe material 3. In this manner, the fit of the inner shoe material can be correspondingly optimized. In particular, the individual or respective (surface) sections of the inner shoe material 3 can be connected to one another by means of sewing, gluing, or welding. In particular, the individual (surface) sections of the inner shoe material 3 can be connected to one another via connecting areas 22*a*, 22*b*, 22*c*, in particular seams, preferably flat seams (cf. FIG. 4).

Figure 4:
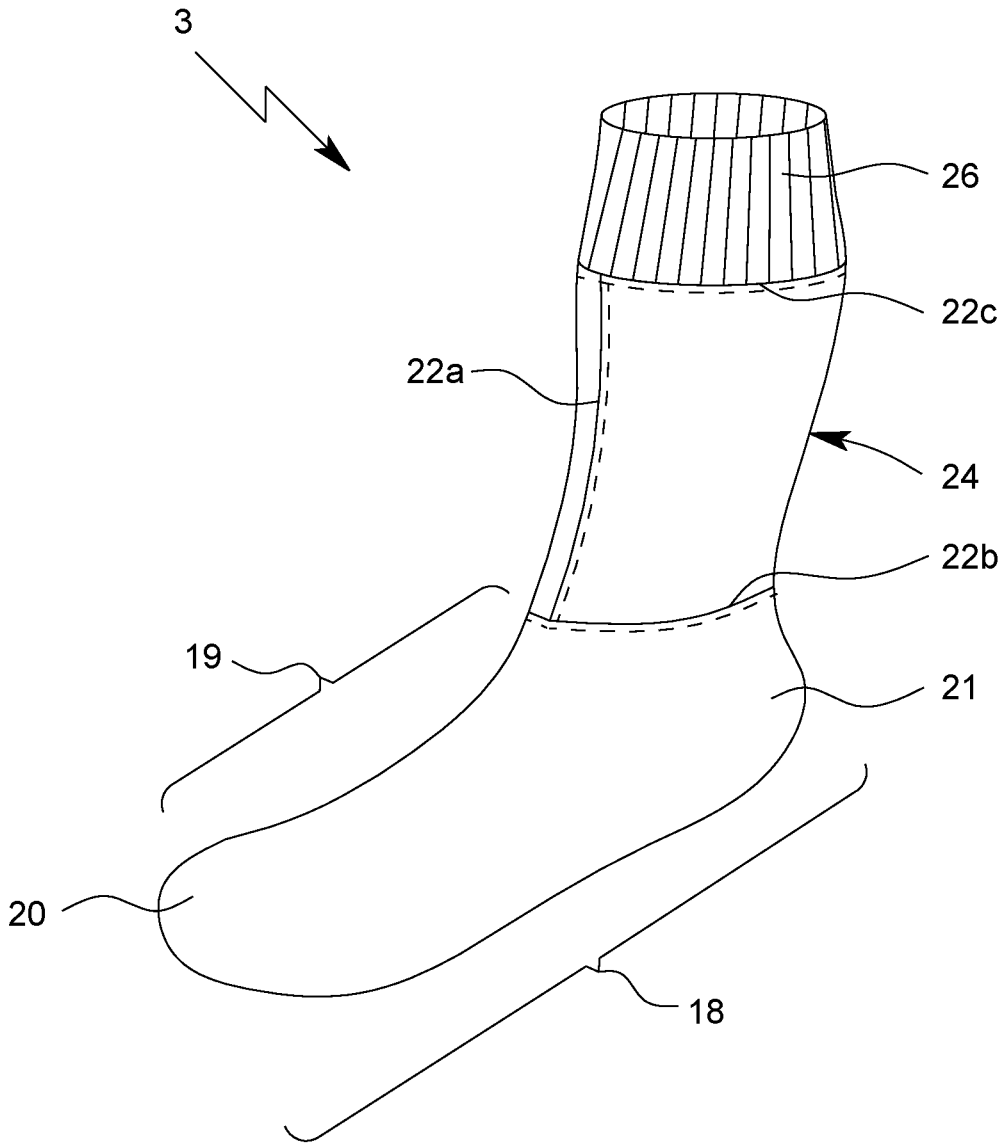
FIG. 4 provides a diagrammatic view in the form of a top view of an inner shoe material on which the functional footwear unit is based in the form of a sock or a stocking.

As also shown in FIG. 4, it can be provided according to an embodiment of the invention that the sole area 18 or the instep area 19 or the toe area 20 and/or the heel or ankle joint area 21 of the inner shoe material 3 is configured to be free of bindings or seams. This improves the wearing comfort of the inner shoe material 3, in particular with respect to minimization of pressure points or the like.

In order to further improve wearing comfort, in particular to reduce pressure points, it can also be provided that the connecting areas of the article of footwear 2 and the connecting areas 22*a*, 22*b*, 22*c* of the inner shoe material 3 are arranged such that that during wear or use of the footwear unit 1, the respective connecting areas of the article of footwear 2 on the one hand and of the inner shoe material 3 on the other at least essentially do not overlap or at least essentially are not arranged at opposite sites or areas of the article of footwear 2 and the inner shoe material 3 during wear or use of the footwear unit 1. Accordingly, the respective connecting areas of seams should not be present or positioned at the same or mutually corresponding sites of the article of footwear 2 and of the inner shoe material 3.

In the context of the present invention, it can also be provided that the inner shoe material 3 comprises at least one contact or connecting device 4*a*, in particular for preferably sectional and/or detachable or non-permanent and/or sealing connection or in particular for sectional or detachable and/or non-permanent or sealing contact of the inner shoe material 3 with the article of footwear 2. In this connection, the contact or connecting device 4*a* can be positioned on the shaft 24 of the inner shoe material 3, in particular on the opening area of the shaft 24, or connected to the shaft 24 of the inner shoe material 3. Reference can be made in particular to FIG. 1 in this case.

In this connection, it can also be provided according to the invention that the article of footwear 2 comprises at least one contact or connecting device 4*b*. The contact or connecting device 4*b* can also be provided in particular for preferably sectional and/or detachable or non-permanent and/or sealing connection or in particular for sectional or detachable and/or non-permanent or sealing contact of the article of footwear 2 with the inner shoe material 3. In this connection, the contact or connecting device 4*b* can be positioned on the shaft 25 of the article of footwear 2, in particular on the opening area of the shaft 25, or connected to the shaft 25 of the article of footwear 2. Reference can be made to FIG. 1 in this case as well.

In this connection, the contact or connecting devices 4*a*, 4*b*, in particular during wear or use of the footwear unit 1, can be arranged or positioned at areas or sites that correspond or are opposite to or in contact with one another of the inner shoe material 3 on the one hand and of the article of footwear 2 on the other, as shown diagrammatically in FIG. 1.

Moreover, with respect to the contact or connecting devices 4*a*, 4*b*, these can for example be configured in the form of a rubber seal, a Velcro fastener, a zipper or the like. In the context of the present invention, the situation here is such that in particular, during wear or use, the contact or connecting devices in question 4*a*, 4*b* form a non-permanent or detachable connection, in particular in the area of the shaft of the article of footwear 2 or the inner shoe material 3, in particular in the opening area of the inner shoe material 3 and of the article of footwear 2. In this manner, secure positioning of the inner shoe material 3 in the article of footwear 2 can be ensured, and the penetration of toxic or harmful substances, in particular in the area between the inner shoe material 3 and the article of footwear 2, can also be prevented, thus making it possible to further improve protective performance.

As shown in FIG. 4, according to a further embodiment, the inner shoe material 3 can comprise a preferably elastic or reversibly stretchable closing band 26. In this case, the closing band 26 can be connected to the shaft 24 of the inner shoe material 3 or to the contact or connecting device 4*a* of the inner shoe material 3, preferably via a connection 22*c*, in particular a seam. The closing band 26 can be located in particular in the opening area of the shaft 24 of the inner shoe material 3. In this connection, it can for example be provided that the contact or connecting device 4*a* of the inner shoe material 3 is arranged or positioned between the closing band 26 and the shaft of the inner shoe material 3.

Moreover, it can also be provided in the context of the present invention that the closing band 26 and/or the contact or connecting device 4*a*, in particular the closing band 26 of the inner shoe material 3, is configured in particular for detachable or in particular non-permanent or non-fixed connection with a hose or a protective suit or the like.

As mentioned above, in the context of the present invention, a footwear unit 1 is provided with an extremely strong protective function against the above-mentioned toxic or harmful substances, which in particular has the following protective properties:

The footwear unit 1 can have a barrier action against harmful or toxic substances, in particular chemical warfare agents, in particular bis[2-chlorethyl]sulfide, determined according to method 2.2 CRDC-SP-84010, of at most 4 $\mu g/cm^2$ per 24 h, in particular at most 3.5 $\mu g/cm^2$ per 24 h, preferably at most 3.0 $\mu g/cm^2$ per 24 h, preferably at most 2.5 $\mu g/cm^2$ per 24 h, particularly preferably at most 2.25 $\mu g/cm^2$ per 24 h, and most particularly preferably at most 2 $\mu g/cm^2$ per 24 h.

In summary, a footwear unit 1 is provided according to the invention which combines the diametrically opposed properties of a strong protective function against toxic or harmful substances, in particular warfare agents, on the one hand and high wearing comfort on the other.

As mentioned above, based on selective combination of the article of footwear 2 and the inner shoe material 3 to obtain the footwear unit 1 according to the invention, the respective components can be further optimized so that in this manner, the special properties with respect to wearing comfort and application properties or manageability can be improved while simultaneously providing a strong protective function: as described above, it can thus be provided that the article of footwear 2 contains no more adsorptive material or no adsorbents, wherein in particular the inner layer 6 of the article of footwear 2 can also be further reduced or even dispensed with, as the properties of a lining material can be taken over by the inner shoe material 3 in particular. Accordingly, with respect to the inner shoe material 3, one can dispense with the use of a (barrier) membrane, which specifically can be a component of the article of footwear 2, thus making it possible to improve wearing comfort and simultaneously provide a strong protective function.

According to the invention, it can also be provided that the seams of the article of footwear 2 (not shown) and the seams 22*a*, 22*b*, 22*c* of the inner shoe material 3 do not run over one another so that pressure points are minimized.

In addition, it can be provided according to the invention that as mentioned above, the inner layer 6 or the inner lining of the article of footwear 2 is not thicker than necessary, as the inner shoe material 3 already contributes to or constitutes the lining.

In particular, it can be provided in the context of the present invention that the materials and in particular the surface of the article of footwear 2 and the seams and other compounds or components in particular of the article of footwear 2, for example with respect to the membrane 7 of the article of footwear 2, are already selected or configured such that penetration or permeation in particular of chemical warfare agents, TICs, biological harmful or toxic substances and the like is prevented by the article of footwear 2 or minimized to the extent that the adsorptive material or the adsorption layer 12 of the inner shoe material 3 present in particular in the form of a sock or a stocking, complementarily to the article of footwear 2, provides complete security or complete protection of the wearer. Accordingly, the article of footwear 2 on the one hand and the inner shoe material 3 of the footwear unit 1 according to the invention on the other complement each other with respect to their protective performance, such that the overall protective performance results from the combination of the article of footwear 2 and the inner shoe material 3 of the footwear unit 1 according to the invention.

As mentioned above in particular, the design according to the invention also has the following advantages:

In particular, the inner shoe material 3 can be regenerated, for example by washing, but can also be separately disposed of, independently of the article of footwear 2, wherein the article of footwear can then be further used.

In addition, an article of footwear 2 that has already been broken in can have its protective function fully restored by replacing the inner shoe material 3, so that the wearer does not have to switch to a boot that has not been broken in. In addition, inner shoe materials 3 that have been pre-damaged by wear, in particular by mechanical forces, can be easily replaced.

Moreover, the concept according to the invention takes into account the respective durability or storage lives of the article of footwear 2 on the one hand and the inner shoe material 3 on the other, as the durability or storage time of the article of footwear 2, in particular resulting from limited duration of the sole connection, is generally less than that of the inner shoe material 3. In this connection, it is also at most necessary, for example, to simply insert or weld the inner shoe material 3 into a protective shell in order to protect the adsorptive material 14. Consequently, it is at most necessary simply to renew or replace the article of footwear 2 after expiration of the possible shorter shelf life.

As mentioned above, the present invention is based on a modular concept, according to which for example full leather or partial leather boots can be combined with a respectively adapted inner shoe material 3 depending on the requirements of the corresponding application or use of the footwear unit.

Moreover, further subject matter of the present invention—according to a further aspect of the present invention—is a method for equipping an article of footwear 2, in particular in the form of a shoe or preferably a boot, with an in particular modular protective function against radioactive toxic or harmful substances and/or against chemical or biological toxic and/or harmful substances, in particular warfare agents, wherein an inner shoe material 3 containing at least one adsorptive material 14, in particular in the form of a sock or preferably a stocking, and the article of footwear 2 are combined as functionally coherent or functionally mutually associated, but disconnected or separate, in particular spatially separated components, in particular in order to form a functional protective clothing unit 1.

The present invention also relates—according to a further aspect of the present invention—to a method for providing a functional footwear unit 1, preferably with an in particular modular protective function against radioactive toxic or harmful substances and/or against chemical or biological toxic and/or harmful substances, in particular warfare agents, wherein an inner shoe material 3 containing at least one adsorptive material 14, in particular in the form of a sock or preferably a stocking, and an article of footwear 2, in particular in the form of a shoe or preferably a boot, are combined as components that are functionally coherent or functionally mutually associated, but are disconnected or separate, particularly spatially.

Moreover, the present invention relates—according to another further aspect of the present invention—to a method for prolonging or increasing the protective function of an article of footwear 2, in particular in the form of a shoe or preferably a boot, against radioactive toxic or harmful substances and/or against chemical and/or biological toxic or harmful substances, in particular warfare agents, wherein an inner shoe material 3 containing at least one adsorptive material 14, in particular in the form of a sock or preferably a stocking, and the article of footwear 2 are combined as components that are functionally coherent or functionally mutually associated, but are disconnected or separate, particularly spatially.

Further subject matter of the present invention—according to another further aspect of the present invention—is the use of an inner shoe material 3 having at least one adsorptive material 14, in particular in the form of a sock or preferably a stocking, for equipping a functional footwear unit 1 with an in particular modular protective function against radioactive toxic or harmful substances and/or against chemical and/or biological toxic or harmful substances, in particular warfare agents, wherein the inner shoe material 3 and an article of footwear 2 are combined as components that are functionally coherent or functionally mutually associated, but are disconnected or separate, particularly spatially.

Moreover, subject matter of the present invention—according to a further aspect of the present invention—is also the use of an inner shoe material 3 having at least one adsorptive material 14, in particular in the form of a sock or preferably a stocking, for prolonging or increasing the protective function of an article of footwear 2, in particular in the form of a shoe or preferably a boot, against radioactive toxic or harmful substances and/or against chemical and/or biological toxic or harmful substances, in particular warfare agents, wherein the inner shoe material 3 and the article of footwear 2 are combined as components that are functionally coherent or functionally mutually associated, but are disconnected or separate, particularly spatially.

With respect to further embodiments and configurations of the present invention, reference can also be made based on the above-described aspects to the explanations of the first aspect of the invention, which concerns the functional footwear unit 1 according to the invention, which shall apply correspondingly.

Further embodiments, changes, variations, modifications, particularities, and advantages of the present invention are readily obvious to and implementable by the person skilled in the art on reading the description without departing from the scope of the present invention.

The present invention is illustrated by the following examples, which, however, by no means limit the present invention.

EXAMPLES

Various foot coverings or footwear units are prepared and investigated below with respect to their protective function against toxic or harmful substances (here specifically: mustard gas, HD). In this respect, the following materials are used:

a) a material based on a conventional leather boot, which comprises leather as an outer layer or upper material and an underlying lining layer, wherein the underlying material contains neither an adsorptive material nor a barrier layer in the form of a membrane (comparison material A);

b) a material based on a leather boot with an integrated adsorptive material in the form of particulate activated carbon; the material comprises leather as an external or upper material and an adsorption layer arranged thereunder, wherein the adsorptive material is in the form of a particulate activated carbon arranged between two textile layers; the material is in the form of a composite with permanent fixation of the respective layers, wherein the particulate activated carbon has a mean particle diameter of approximately 0.3 mm and is fastened with an application amount of approximately 80 g/m$^2$ using an adhesive agent that is applied in a discontinuous punctate manner (comparison material B);

c) a material in the form of a functional footwear unit using an article of footwear in the form of a leather boot (leather as an outer or upper material with a textile lining layer arranged thereunder) and a separate air-permeable inner shoe material with an adsorption layer, wherein a particulate activated carbon with a mean particle diameter of approximately 0.3 mm is fastened on a textile inner layer or a carrier material in an application amount of approximately 80 g/m$^2$ using an adhesive that is applied in a discontinuous-punctate manner and wherein the inner shoe material further comprises a further covering layer, wherein the adsorptive material is arranged between the wearer and the covering layer; the material is thus based on two composite materials arranged on each other in a loose arrangement in the form of the article of footwear on the one hand and the inner shoe on the other (material according to the invention C);

d) a further material, which corresponds to the material according to the invention C described in section c), with the proviso that the outer layer or the upper material in the form of leather of the article of footwear is additionally provided with an oleophobic or hydrophobic agent or coating (material according to the invention D).

In the following, the protective function against a toxic or harmful material in the form of mustard gas (in liquid form) is determined by means of a standardized double flow test. For this purpose, the above-mentioned test materials are clamped in the form of respective sections or samples (respective sample area 10 cm$^2$) into a test cell above a PE membrane (10 μm) that simulates human skin. The substance to be tested in the form of mustard gas is applied with a cannula to the surface of the respective test material in liquid form and in a specified volume and allowed to act, and it is then impinged upon by an air flow above and below the test material, wherein the substance to be tested is applied to the respective leather layer materials. The samples according to comparison materials A and B have the respective composite or layer structure with the respective solidly attached layers, while the materials according to the invention C and D respectively are present in the form of a loose arrangement of the footwear material on the inner shoe material, wherein the footwear material on the one hand and the inner shoe material on the other are both solid composites, as discussed above.

The cumulative penetration values are then determined by means of gas chromatography (relative humidity 80%, temperature 30° C., 250 ml/min air flow above the test material and 300 ml/min air flow below the material, maximum test duration 24 hr). The present test simulates the diffusion and penetration through the test material of the toxic or harmful substances used, thus simulating the planar contact of the respective materials with the skin, which is specifically simulated by the above-described PE membrane. The results are shown in the following table:

| | Penetration 0 to 6 hr (μg per cm$^2$) | Penetration 6 to 24 hr (μg per cm$^2$) | Penetration 0 to 24 hr (μg per cm$^2$) |
|---|---|---|---|
| Comparison material A | 9.1 | 12.5 | 21.6 |
| Comparison material B | 0.2 | 0.5 | 0.7 |
| Material according to the invention C | not determinable | 0.2 | 0.2 |
| Material according to the invention D | not determinable | 0.1 | 0.1 |

The experiments show that the protective action against liquid toxic or harmful substances is significantly improved for the material according to the invention C with the combined arrangement of the material for an article of footwear and the separate inner shoe material, wherein the protective action can be further increased by additionally imparting oleophobic or hydrophobic properties to the material for the article of footwear (material D).

Without wishing to limit ourselves to this theory, the present measure according to the design of the invention, namely that of arranging the adsorptive material in a separate inner shoe material which is in a loose or non-connected arrangement with respect to the material of the article of footwear, gives rise to a further intermediate layer in the form of an air layer between article of footwear on the one hand and the inner shoe material on the other, which leads to improved convection inside the material and thus to optimized incident flow properties of the adsorptive material and better utilization of the adsorption layer, accompanied by improved adsorption behavior with respect to the toxins or harmful substances in question.

The materials according to the invention thus show significantly improved protective properties compared to the prior art.

LIST OF REFERENCE SIGNS

1 Footwear unit
2 Article of footwear
**2*a*** Multilayer structure/laminate/multilayer material of the article of footwear
3 Inner shoe material
**3*a*** Multilayer structure/laminate/multilayer material of the inner shoe material
**4*a*** Contact or connecting device of the inner shoe material
**4*b*** Contact or connecting device of the article of footwear
5 Outer and/or covering layer of the article of footwear
6 Inner layer of the article of footwear
7 Membrane of the article of footwear
8 Spacing layer of the article of footwear
**9*a*** Oleophobic and/or hydrophobic equipment and/or layer of the article of footwear
**9*b*** Fire and/or flame-retardant equipment and/or layer of the article of footwear
10 Inner layer and/or carrier material of the inner shoe material
11 Outer layer of the inner shoe material
12 Adsorption layer of the inner shoe material
13 Carrier of the adsorption layer
14 Adsorptive material
**15*a*, 15*b*** Adhesive layer of the adsorption layer
16 Spacing layer of the inner shoe material
17 Membrane of the inner shoe material
18 Sole area of the inner shoe material
19 Instep area of the inner shoe material
20 Toe area of the inner shoe material

21 Ankle joint area of the inner shoe material

22*a*, 22*b*, 22*c* Connecting areas or seams of the inner shoe material

23 Sole of the article of footwear

24 Shaft of the inner shoe material

25 Shaft of the article of footwear

26 Closing band of the inner shoe material

The invention claimed is:

1. A functional footwear unit in the form of a kit, wherein the functional footwear unit provides a modular protective function against at least one of radioactive toxic and harmful substances, chemical toxic and harmful substances, biological toxic and harmful substances and warfare agents, wherein the footwear unit comprises, as functionally coherent and functionally mutually associated but disconnected and separate components:

(A) an article of footwear in the form of one of a shoe and a boot, wherein the article of footwear is configured to be water-impermeable and air-impermeable, but water vapor-permeable, and wherein the article of footwear contains no adsorptive material, and (B) an inner shoe material in the form of a foot covering material, comprising at least one adsorptive material for prolonging and increasing the protective function of the article of footwear, wherein the adsorptive material is activated carbon in the form of activated carbon particles in granular or spherical form, wherein the inner shoe material is configured to be air-permeable, water-permeable, and water vapor-permeable, and wherein the inner shoe material is in the form of one of a sock and a stocking;

wherein the inner shoe material lies loosely and in an unconnected manner on the article of footwear during wear and use, and wherein the inner shoe material is provided for arrangement during wear and use on the inside of the article of footwear; and wherein the article of footwear comprises a flame-retardant sole, wherein the sole is at least one of water-impermeable and air-impermeable.

2. The footwear unit according to claim 1, wherein the article of footwear, during wear and use, lies against the inner shoe material in a loose and unconnected manner.

3. The footwear unit according to claim 1, wherein the article of footwear has a multilayer structure.

4. The footwear unit according to claim 1, wherein the article of footwear is configured in multiple layers in the form of a laminate.

5. The footwear unit according to claim 1, wherein the article of footwear has a multilayer structure comprising: a covering layer, wherein the covering layer, during wear and use, is provided on the outside of the article of footwear, and an inner layer, wherein the inner layer, during wear and use, is provided on the inside of the article of footwear.

6. The footwear unit according to claim 1, wherein the article of footwear additionally comprises at least one membrane.

7. The footwear unit according to claim 1, wherein the article of footwear additionally comprises at least one of an oleophobic equipment and a hydrophobic equipment, wherein the equipment is provided on the side of the article of footwear facing towards the toxic and harmful substances during wear and use.

8. The footwear unit according to claim 1, wherein the article of footwear additionally comprises at least one of a fire-retardant equipment and a flame-retardant equipment, wherein the equipment is in the form of an impregnation or coating.

9. The footwear unit according to claim 1, wherein the inner shoe material has a multilayer structure.

10. The footwear unit according to claim 1, wherein the inner shoe material is configured in multiple layers in the form of a laminate.

11. The footwear unit according to claim 1, wherein the inner shoe material has a multilayer structure comprising: at least one inner layer and a carrier material, wherein the inner layer, during wear and use, is provided on the inside of the inner shoe material, and at least one outer layer, wherein the outer layer, during wear and use, is provided on the outer side of the inner shoe material, and at least one adsorption layer, with the adsorption layer comprising or being composed of the adsorptive material, wherein the adsorption layer is arranged between the inner layer and the outer layer.

12. The footwear unit according to claim 1, wherein the inner shoe material has an air permeability, measured according to DIN 53887 at a flow resistance of 127 Pa of at least 200 $l/m^2$ per second.

13. The footwear unit according to claim 1, wherein the adsorptive material has a granular configuration, wherein the adsorptive material has a diameter in the range of 0.005 mm to 2.5 mm.

14. The footwear unit according to claim 1, wherein the adsorptive material is fixed on a carrier material.

15. The footwear unit according to claim 1, wherein the adsorptive material is fixed on a carrier material via at least one adhesive layer, wherein the adhesive layer is applied to the carrier material as a discontinuous and air-permeable layer.

16. The footwear unit according to claim 1, wherein the inner shoe material does not comprise any air-impermeable layer.

17. The footwear unit according to claim 1, wherein the functional footwear unit has a barrier functional against toxic and harmful substances selected from the group of radioactive toxic and harmful substances, chemical toxic and harmful substances, biological toxic and harmful substances and warfare agents, determined according to Method 2.2 of CRDC-SP-84010, of at most 4 $\mu g/cm^2$ per 24 h.

18. A functional footwear unit in the form of a kit, wherein the functional footwear unit provides a modular protective function against at least one of radioactive toxic and harmful substances, chemical toxic and harmful substances, biological toxic and harmful substances and warfare agents, wherein the footwear unit comprises, as functionally coherent and functionally mutually associated but disconnected and separate components:

(A) an article of footwear in the form of one of a shoe and a boot, wherein the article of footwear is configured to be water-impermeable and air-impermeable, but water vapor-permeable, and wherein the article of footwear contains no adsorptive material, and (B) an inner shoe material in the form of a foot covering material, comprising at least one adsorptive material for prolonging and increasing the protective function of the article of footwear, wherein the adsorptive material is activated carbon in the form of activated carbon particles in granular or spherical form, wherein the inner shoe material is configured to be air-permeable, water-permeable and water vapor-permeable, and wherein the inner shoe material is in the form of one of a sock and a stocking;

wherein the inner shoe material lies loosely and in an unconnected manner on the article of footwear during wear and use, wherein the inner shoe material is provided for arrangement during wear and use on the inside of the article of footwear;

wherein the article of footwear comprises a flame-retardant sole, wherein the sole is at least one of water-impermeable and air-impermeable; and wherein the functional footwear unit has a barrier functional against toxic and harmful substances selected from the group of radioactive toxic and harmful substances, chemical toxic and harmful substances, biological toxic and harmful substances and warfare agents, determined according to Method 2.2 of CRDC-SP-84010, of at most 4 $\mu g/cm^2$ per 24 h.

19. A functional footwear unit in the form of a kit, wherein the functional footwear unit provides a modular protective function against at least one of radioactive toxic and harmful substances, chemical toxic and harmful substances, biological toxic and harmful substances and warfare agents, wherein the footwear unit comprises, as functionally coherent and functionally mutually associated but disconnected and separate components:

(A) an article of footwear in the form of a shoe or a boot, wherein the article of footwear is configured to be water-impermeable and air-impermeable, but water vapor-permeable, and wherein the article of footwear contains no adsorptive material, and (B) an inner shoe material in the form of a foot covering material, comprising at least one adsorptive material in the form of a sock or a stocking for prolonging and increasing the protective function of the article of footwear, wherein the adsorptive material is activated carbon in the form of activated carbon particles in granular or spherical form, wherein the inner shoe material is configured to be air-permeable, water-permeable and water vapor-permeable, and wherein the inner shoe material is in the form of one of a sock and a stocking;

wherein the inner shoe material lies loosely and in an unconnected manner on the article of footwear during wear and use wherein the inner shoe material is provided for arrangement during wear and use on the inside of the article of footwear;

wherein the inner shoe material has an air permeability, measured according to DIN 53887 at a flow resistance of 127 Pa of at least 200 $l/m^2$ per second; and wherein the functional footwear unit has a barrier functional against toxic and harmful substances selected from the group of radioactive toxic and harmful substances, chemical toxic and harmful substances, biological toxic and harmful substances and warfare agents, determined according to Method 2.2 of CRDC-SP-84010, of at most 4 $\mu g/cm^2$ per 24 h.

20. A method for prolonging and increasing the protective function of an article of footwear providing a protective function against at least one of radioactive toxic and harmful substances, chemical toxic and harmful substances, biological toxic and harmful substances and warfare agents, wherein the method comprises the following steps:

an inner shoe material in the form of a sock or a stocking and comprising at least one adsorptive material is combined with an article of footwear in the form of a shoe or a boot as functionally coherent and functionally mutually associated but disconnected and separate components, wherein the article of footwear is configured to be water-impermeable and air-impermeable but water vapor-permeable and wherein the article of footwear contains no adsorptive material, wherein the inner shoe material is configured to be water-permeable and air-permeable and water vapor-permeable, wherein the inner shoe material includes at least one adsorptive material for prolonging and increasing the protective function of the article of footwear, wherein the adsorptive material is activated carbon in the form of activated carbon particles in granular or spherical form, wherein the inner shoe material is provided for arrangement during wear and use on the inside of the article of footwear, and wherein the inner shoe material is arranged such to lie loosely and in an unconnected manner on the article of footwear during wear and use.

* * * * *